US006116939A

United States Patent [19]

Fukuda

[11] Patent Number: 6,116,939

[45] Date of Patent: Sep. 12, 2000

[54] CONNECTOR LOCK MECHANISM

[75] Inventor: Masaru Fukuda, Shizuoka, Japan

[73] Assignee: Yazaki Corporation, Tokyo, Japan

[21] Appl. No.: 09/292,852

[22] Filed: Apr. 16, 1999

[30] Foreign Application Priority Data

Apr. 17, 1998 [JP] Japan ..... 10-107884
Feb. 15, 1999 [JP] Japan ..... 11-036322

[51] Int. Cl.[7] ..... H01R 13/627

[52] U.S. Cl. ..... 439/354; 439/923

[58] Field of Search ..... 439/354, 357, 439/358, 372, 923

[56] References Cited

U.S. PATENT DOCUMENTS

| | | | |
|---|---|---|---|
| 5,496,190 | 3/1996 | Ittah et al. | 439/354 |
| 5,507,666 | 4/1996 | Yamanashi | 439/489 |
| 5,711,684 | 1/1998 | Inoue et al. | 439/354 |
| 6,027,364 | 2/2000 | Fukuda | 439/489 |

*Primary Examiner*—Khiem Nguyen
*Attorney, Agent, or Firm*—Sughrue, Mion, Zinn, Macpeak & Seas, PLLC

[57] ABSTRACT

A connector lock mechanism which not only can prevent half engagement between a set of connectors but also can remove the two connectors from each other easily. The connector lock mechanism (100) according to the invention includes a pair of flexible elastic pieces (20) which can be flexed and shifted integrally with a flexible arm (15) capable of pressing against a female connector (20) as a male connector (10) is engaged with the male connector (20). Additionally, the connector lock mechanism (100) includes a pair of push-out guide surfaces (26) which are contacted with the flexible elastic pieces (18) and receive a pressing force therefrom and also which applies part of the reactive force of the pressing force from the flexible elastic pieces (18) onto the male connector (10) to thereby energize the male connector (10) in a direction where the male connector (10) is removed from the female connector (20). Further, the connector lock mechanism (100) includes guide surfaces (28) which, when the flexible elastic pieces (18) are flexed and shifted together with the flexible arm (15), can guide the engaging projections (19) of the flexible elastic pieces (18) from stepped surfaces (27) serving as engaging portions onto the push-out guide surfaces (26) to thereby remove the engagement between the engaging projections (19) and stepped surfaces (27).

16 Claims, 26 Drawing Sheets

CONNECTOR LOCK MECHANISM

BACKGROUND OF THE INVENTION

1. Field of the Invention

The present invention relates to a connector lock mechanism which electrically connects together a pair of male and female connectors by means of mutual engagement between them and, in more particular, to a connector lock mechanism including a removing mechanism which, when the male and female connectors are half engaged, is able to push the two connectors away from each other.

2. Background of the Invention

Conventionally, a set of male and female connectors are used to electrically connect a plurality of electrical wires together. When the male and female connectors are engaged with each other, the connecting terminals respectively stored within the housings of the two connectors are connected with each other to thereby electrically connect the two connectors with each other.

When the male and female connectors are incompletely or half engaged with each other, there is a possibility that the two connectors are not electrically connected to each other. To avoid this, for example, as disclosed in Japanese Patent Publication No. 10-41014, there is proposed male and female connectors structured such that, when the male and female connectors are incompletely engaged to each other, the two connectors can be removed from each other to thereby prevent the half engagement between the male and female connectors.

Referring to FIG. 27, there is shown a connector lock mechanism 1 which relates to the male and female connectors disclosed in the above-mentioned Japanese Patent Publication No. 10-41014. In this connector lock mechanism 1, a female-type connecting terminal 3 is stored within a male connector 2, whereas a male-type connecting terminal 5 is stored within a female connector 4. A flexible securing piece 6, which is provided on the male connector 2, is engageable with an engaging projection 7 provided on the female connector 4, to lock the female and male connectors 4 and 2 in their mutually engaged condition.

The engaging projection 7 includes a gently inclined surface 7*a* and a steeply inclined surface 7*b* so that its cross sectional forms a triangular shape. Due to this shape, if the two connectors 2 and 4 are incompletely engaged with each, the leading end portion 6*a* of the flexible securing piece 6 slides down along the gently inclined surface 7*a* owing to its own flexing property, so that the two connectors 2 and 4 are separated or removed from each other in their mutually removing directions. On the other hand, if the two connectors 2 and 4 are completely engaged and the two female- and male-type connecting terminals 3 and 5 are thereby connected together electrically, then the leading end portion of the flexible securing piece 6 slides down the steep inclined surface 7*b* and is thereby engaged with the engaging projection 7 completely, with the result that the two connectors 2 and 4 are locked in the completely engaged condition.

In the above-mentioned connector lock mechanism 1 disclosed in Japanese Patent Publication No. 10-41014, when removing the two connectors 2 and 4 from each other, the leading end portion 6*a* of the flexible securing piece 6 must be raised with respect to the female connector 4. However, a hold member 8 is provided above the flexible securing piece 6 for preventing the flexible securing piece from rising up. Therefore, the two connectors 2 and 4 are prevented from being removed from each other. The problem with this arrangement is that it is difficult to raise the flexible securing piece 6 in order to remove the two connectors 2 and 4 from each other.

Also, in the above-mentioned connector lock mechanism 1 disclosed in Japanese Patent Publication No. 10-41014 of Keisei, the mutual contact between the leading end portion 6*a* of the flexible securing piece 6 and the gently inclined surface 7*a* of the engaging projection 7 generates a removing force to urge the two connectors 2 and 4 away from each other. Accordingly, if the flexible securing piece 6 is raised, then the removing force for urging the two connectors 2 and 4 away from each other cannot be generated any longer, so that the operation to remove the two connectors 2 and 4 from each other cannot be executed easily.

In an automobile, connectors are employed in various uses. In particular, because of highly advanced electronically controlled equipment and also because AV devices are carried on board the automobile, the number of connecting terminals to be assembled by a set of connectors has increased. With an increase in the number of connecting terminals, the friction resistance between the connecting terminals also increases. Therefore, after the mutually engaged condition between the two connectors 2 and 4 is removed, a large force is required to disconnect the two connectors 2 and 4.

In view of the above, it is preferred that a force to remove the two connectors 2 and 4 from each other be generated simultaneously to when the mutual securing between them is removed. However, unless (with the flexible securing piece 6 pushed up) the female connector 4 is pulled out slightly and the leading end portion 6*a* of the flexible securing piece 6 is placed on the gently inclined surface 7*a* of the engaging projection 7, a removing force cannot be generated to push out the female connector 4.

Also, as the angle of the gently inclined surface 7*a* increases, the removing force also increases. However, if the angle increases, then the push-out distance of the connectors becomes smaller. Therefore, if the connecting terminals 3 and 4 are not urged away from each other completely, then they must be pulled out with a further strong force.

Further, if the inclined surface 7*a* of the engaging projection 7 is not smooth, then the sliding condition of the leading end portion 6*a* is poor so that the removing force also becomes weak. However, in the conventional connectors 2 and 4, there is no means for enhancing the sliding condition of the leading end portion 6*a*.

SUMMARY OF THE INVENTION

The present invention aims at eliminating the above-mentioned drawbacks found in the conventional connector lock mechanism. Accordingly, it is an object of the invention to provide a connector lock mechanism which not only can prevent half engagement between a set of connectors but also can remove the two connectors from each other easily.

In attaining the above object, according to one aspect of the invention, there is provided a connector lock mechanism structured such that a flexible arm is provided in one of a set of connectors to be engaged with each other, one connector is engaged into an engagement recess formed in the other connector, and, by flexing the flexible arm, one connector is pulled out from the engagement recess to thereby remove the set of connectors from each other. The present connector lock mechanism comprises: a pair of flexible elastic pieces respectively provided on the two side portions of the flexible arm; a pair of engaging projections respectively provided on the respective outer surfaces of the pair of flexible elastic pieces; a pair of taper-surface-shaped push-out guide surfaces respectively formed in the inner surfaces of the engagement recess in such a manner that the engaging projections can slide on the push-out guide surfaces as the one connector engaged with or removed from the engagement recess of the other connector; a pair of engaging portions respectively formed in the engagement recess of the other connector in such a manner that the engaging projections can be respectively secured to the engaging portions when the other connector is completely engaged with one connector; and, a pair of guide surfaces respectively formed in the engagement recess in such a manner that, as the flexible elastic pieces are flexed and deformed together with the flexible arm, they can guide the engaging projections from the engaging portions onto the push-out guide surfaces to thereby remove the mutual engagement between the engaging projections and the engaging portions.

Also, according to the above-mentioned connector lock mechanism, preferably, the flexible arm may include a space which is capable of shifting the pair of flexible elastic pieces respectively in their inward directions.

Further, according to the above-mentioned connector lock mechanism, preferably, the above-mentioned one connector is always receiving from the engagement recess of the other connector a removing force to act on the one connector in its removing direction except when the present one connector is completely engaged with the other connector.

Still further, according to above-mentioned connector lock mechanism, preferably, the flexible arm may comprise a securing projection which includes a forwardly descending, gently inclined surface capable of sliding on the lower surface of a securing portion formed on the other connector side as the two connectors are engaged with each other, and also which, when the two connectors are completely engaged with each other, can be engaged with the securing portion of the other connector.

In attaining the above object, according to the other aspect of the invention, there is provided a connector lock mechanism structured such that a flexible arm is provided in one of a set of connectors to be engaged with each other, the present one connector is engaged into an engagement recess formed in the other connector, and, by flexing the flexible arm, the present one connector is pulled out from the engagement recess of the other connector to thereby remove the set of connectors from each other. The connector lock mechanism comprises a pair of flexible elastic pieces respectively provided on the two side portions of the flexible arm and including a space formed between them and capable of shifting the two flexible elastic pieces respectively in their inward directions; a pair of engaging projections respectively provided on the outer surfaces of the pair of flexible elastic pieces; and, a pair of push-out guide surfaces respectively formed as tapered surfaces in the inner surfaces of the engagement recess of the other connector in such a manner that the pair of engaging projections are allowed to slide on the push-out guide surfaces as the present one connector is engaged with or removed from the engagement recess of the other connector, wherein the pair of flexible elastic pieces are formed obliquely with respect to the engaging direction of the present one connector in order to be able to increase a removing force which is always applied to the present one connector from the engagement recess of the other connector as the present one connector is engaged with and removed from the other connector except when the present one connector is completely engaged with the other connector.

Also, according to the above-mentioned connector lock mechanism, preferably, the engagement recess of the other connector may include engaging portions to which the engaging projections can be secured when the other connector is engaged with one connector completely, and guide surfaces which, as the flexible elastic pieces are flexed and shifted together with the flexible arm, can guide the engaging projections from the engaging portions onto the push-out guide surfaces to thereby remove the engagement between the engaging projections and engaging portions.

Also, according to the above-mentioned connector lock mechanism, preferably, the front end faces of the engaging projections which can slide on the push-out guide surfaces as the present one connector is pushed into the engagement recess of the other connector may be respectively formed as arc surfaces, and the leading end faces of the engaging projections that are to be contacted directly with the push-out guide surfaces may be respectively formed as straight surfaces.

Further, according to the above-mentioned connector lock mechanism, preferably, the mold matching positions of metal molds used to mold the set of connectors may be set in the rear end portions of the straight surfaces of the engaging projections, thereby preventing projections from being formed on the straight surfaces of the engaging projections to be contacted with the push-out guide surfaces when the molds are matched to each other.

Still further, according to the above-mentioned connector lock mechanism, preferably, the surfaces of the connectors that have been mirror-surface finished by the metal molds include at least one of the following portions: that is, the engaging projections, the push-out guide surfaces, the gently inclined surface of the securing projection, the bottom surface of the engagement recess of the other connector, and the lower surface of the housing of one connector.

In the above-structured connector lock mechanism according to the invention, as one connector is engaged with the other connector, the flexible elastic pieces respectively receives a pressing force from their associated push-out guide surfaces through the engaging projections and, at the same time, the securing projections provided on the flexible arm also receive a pressing force from the securing portion of the other connector. Due to this, until the two connectors are completely engaged with each other, one connector receives from the other connector a strong removing force which acts on one connector in the removing direction thereof, thereby being able to prevent the incomplete or half engagement between the two connectors positively.

Also, in a state where the two connectors are completely engaged together, the engaging projections formed on the flexible elastic pieces are engaged with their associated engaging portions of the other connector, which makes it possible to lock the two connectors in their mutually engaged condition more strongly.

Also, to remove the two connectors from each other, the engagement between the securing projection on the flexible arm and the securing portion of the other connector is removed. That is, if the flexible arm is flexed and shifted, then the flexible elastic pieces are shifted in the flexing direction integrally with the flexible arm. At the same time, the engaging projections provided on the flexible elastic pieces are guided onto the push-out guide surfaces by the guide surfaces, thereby removing the engagement between the engaging projections of the flexible elastic pieces and the engaging portions of the other connector.

Also, in a state where the flexible arm is flexed and deformed, the flexible elastic pieces are flexed and shifted as the engaging projections are guided onto the push-out guide surfaces, while the amount of deformation of the flexible elastic pieces is caused to increase due to the space formed between the flexible elastic pieces.

Further, if the flexible elastic pieces are set obliquely with respect to the engaging direction of one connector, then the amount of deformation of the flexible elastic pieces increases, which in turn increases the removing force to push out one connector. This makes it possible not only to surely detect the incomplete or half engagement between the set of connectors but also to facilitate the operation to remove the two connectors from each other.

Also, the surfaces to be contacted with each other as the set of connectors are engaged with or removed from each other are molded by the metal molds that have been mirror-surface finished and, at the same time, the leading end faces of the engaging projections to be contacted with the push-out guide surfaces are formed as straight surfaces. Further, the mold matching positions of the molds used to mold the connectors are set in the rear end portions of the straight surfaces. This can reduce frictional resistance between the two connectors, can increase the above-mentioned removing force, and makes it possible to execute the two connectors mutually engaging and removing operations smoothly and positively.

DETAILED DESCRIPTION OF THE PREFERRED EMBODIMENTS

Figures 1A, 1B:
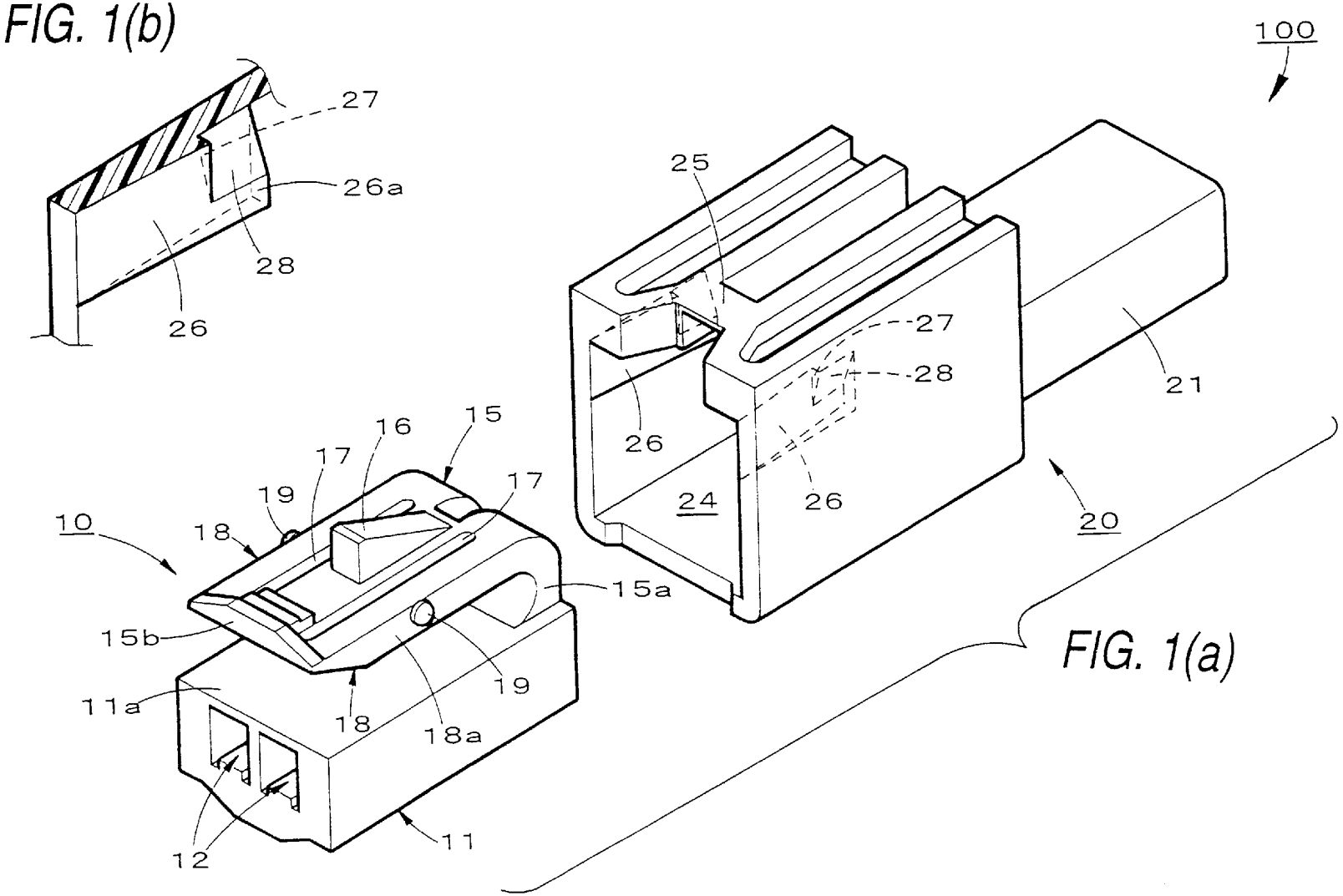
FIGS. 1(*a*) and 1(*b*) are exploded perspective views of a first embodiment of a connector lock mechanism according to the invention.
Figure 2:
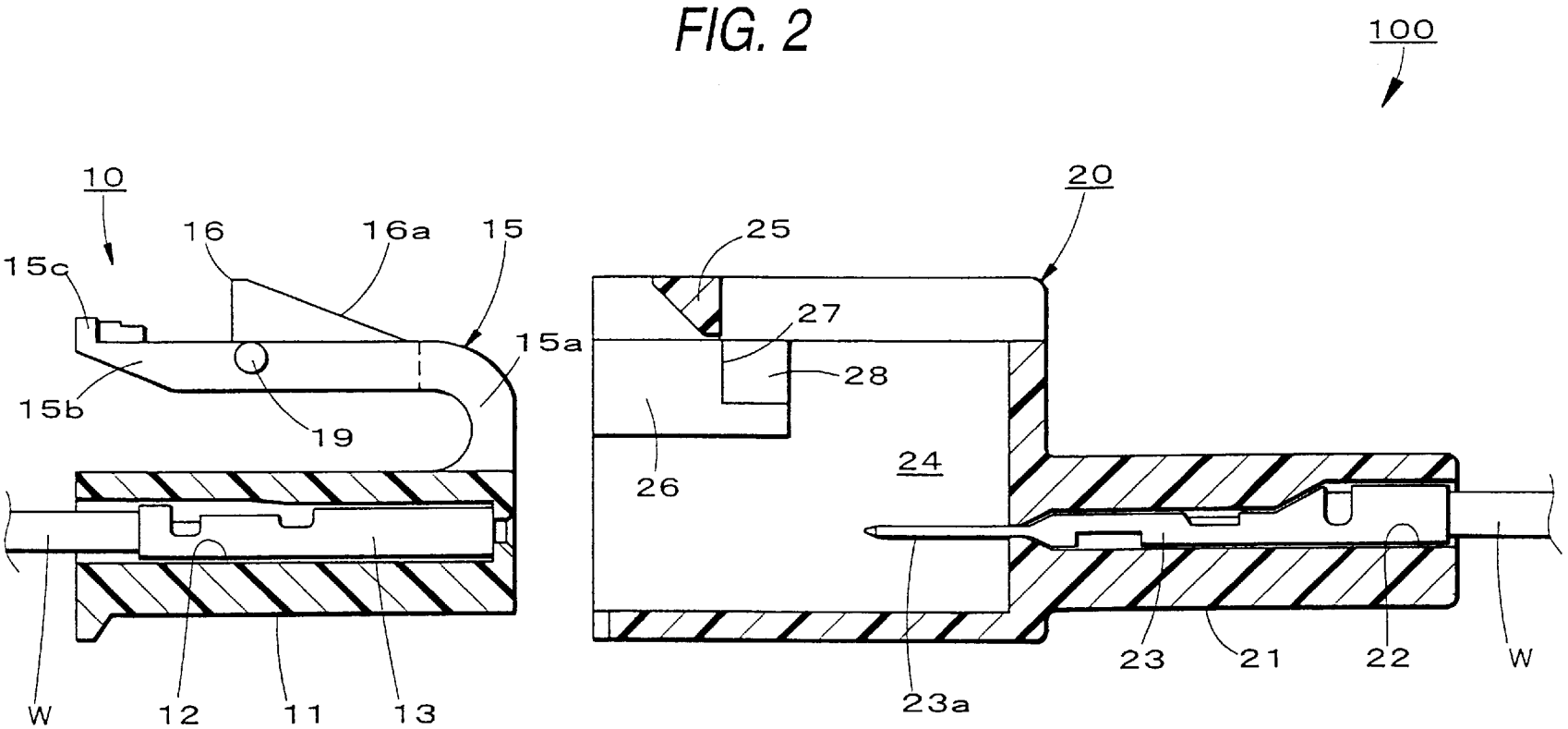
FIG. 2 is a longitudinal sectional view of the connector lock mechanism shown in FIG. 1.
Figure 3:
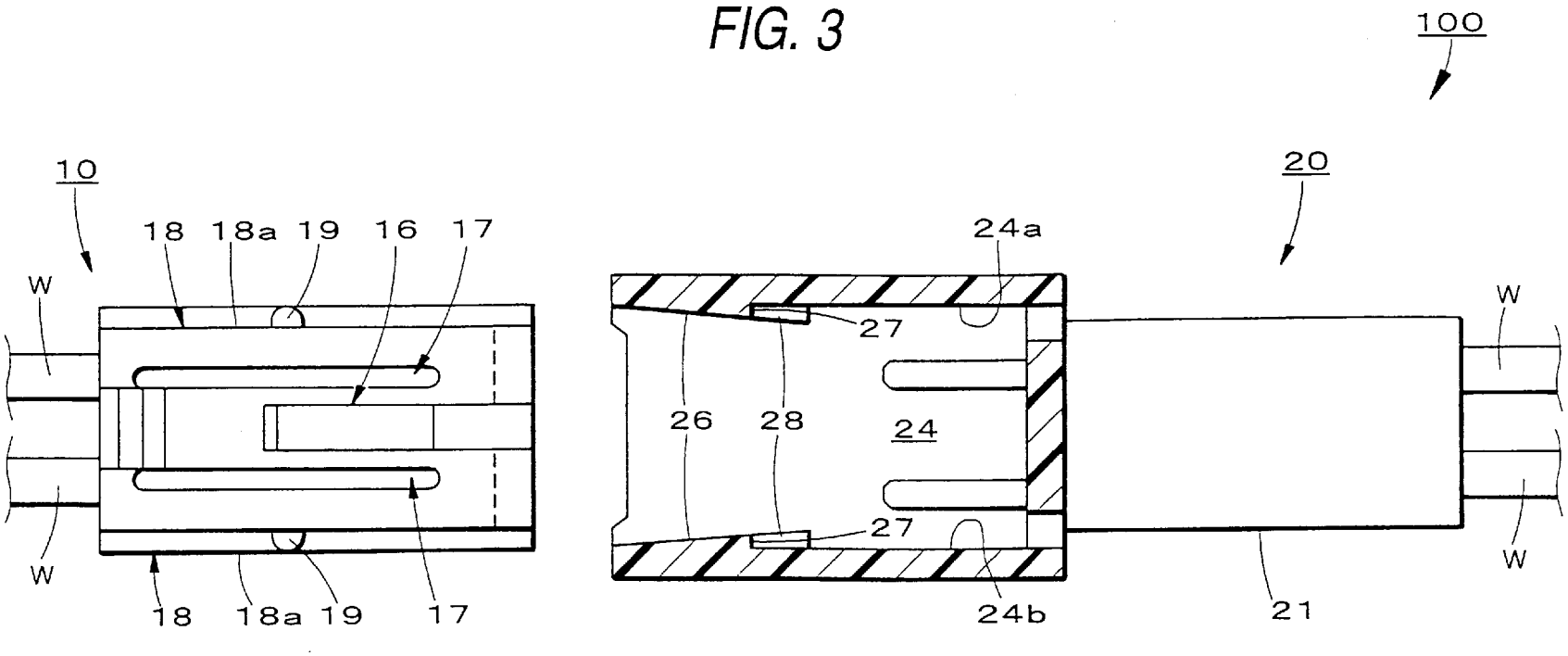
FIG. 3 is a transverse sectional view of the connector lock mechanism shown in FIG. 1.
Figure 4:
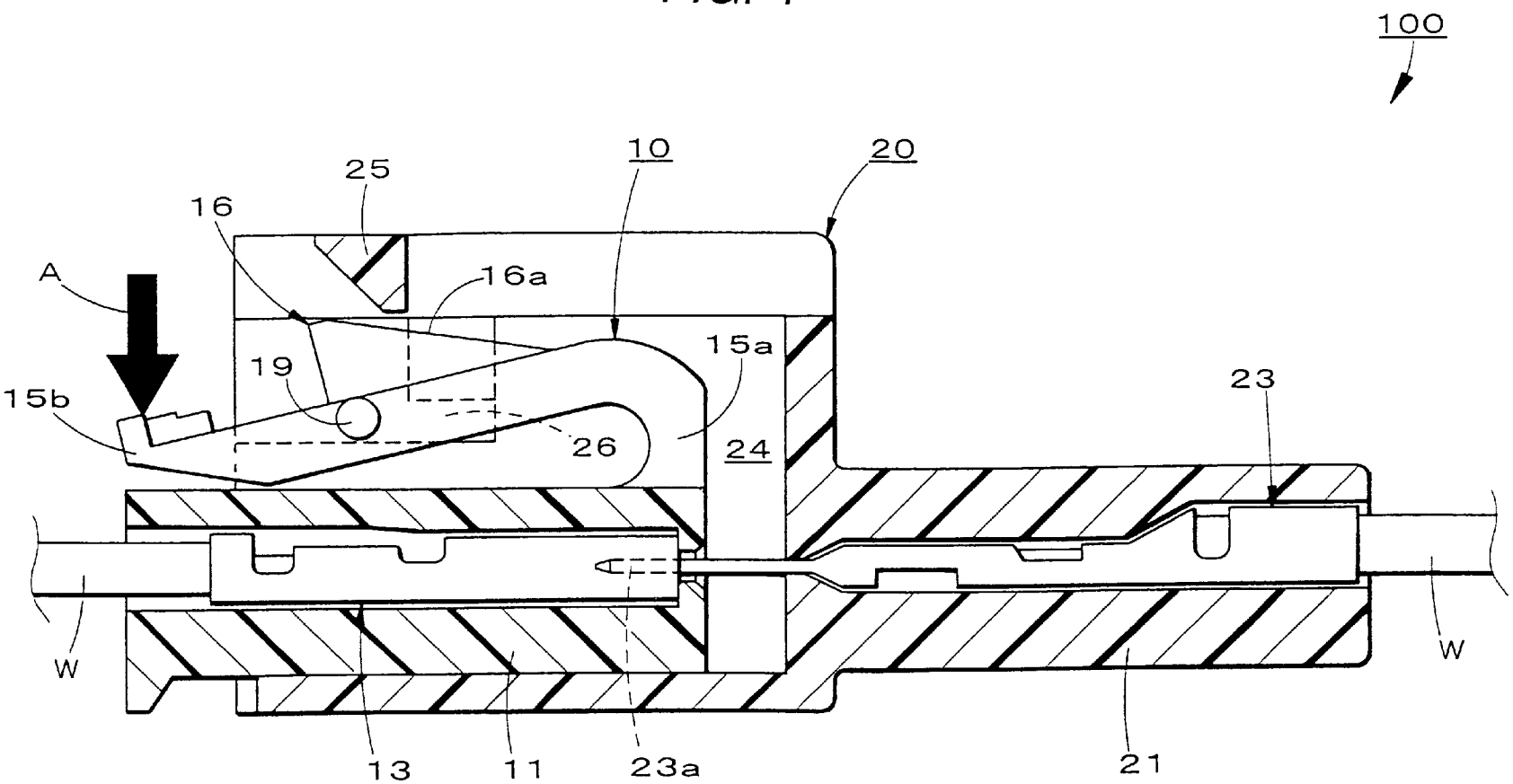
FIG. 4 is a longitudinal sectional view of the connector lock mechanism shown in FIG. 1, showing the half engagement between two connectors.
Figure 5:
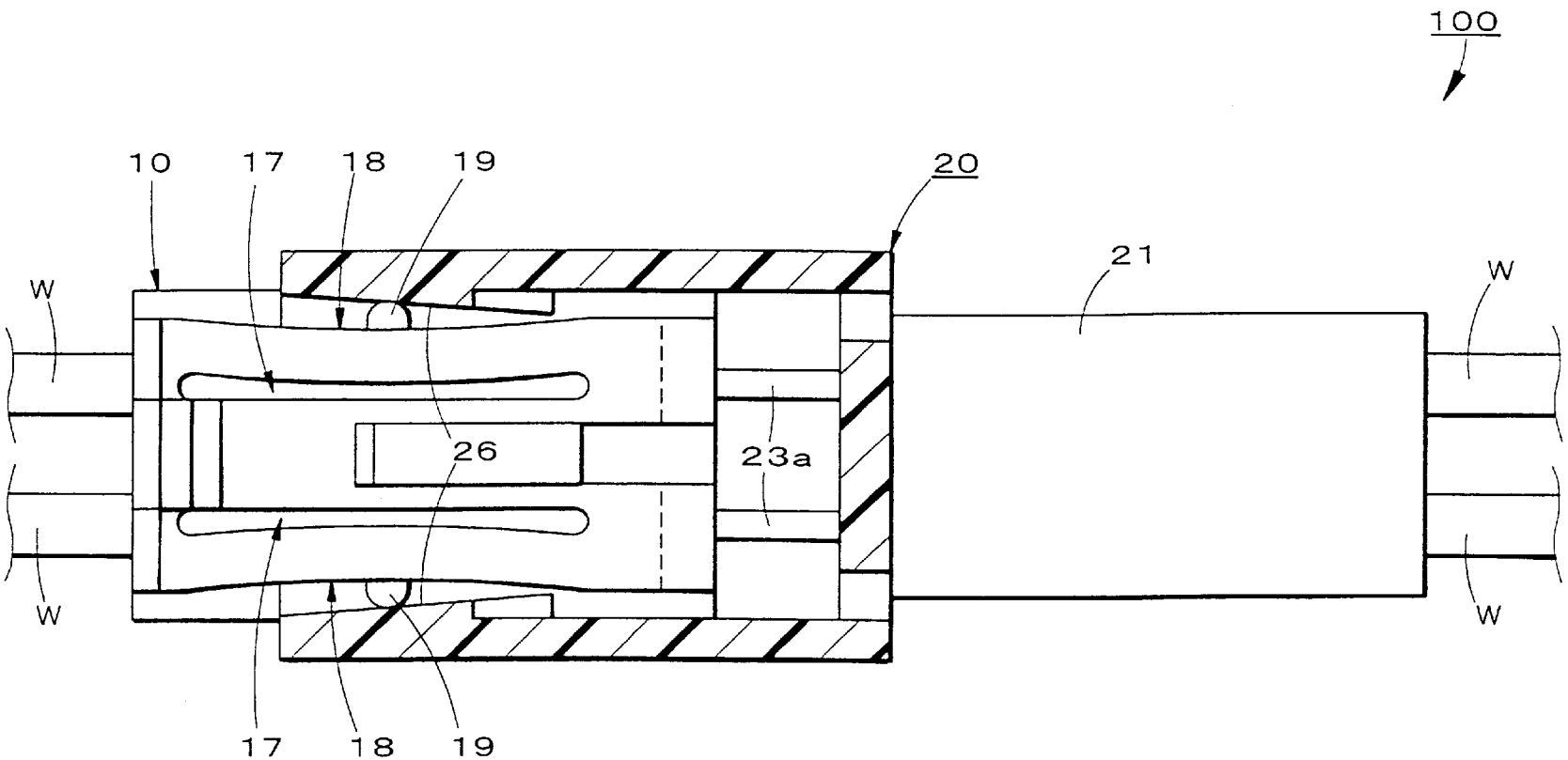
FIG. 5 is a transverse sectional view of the connector lock mechanism shown in FIG. 1, showing the half engagement between the two connectors shown in FIG. 4.
Figure 6:
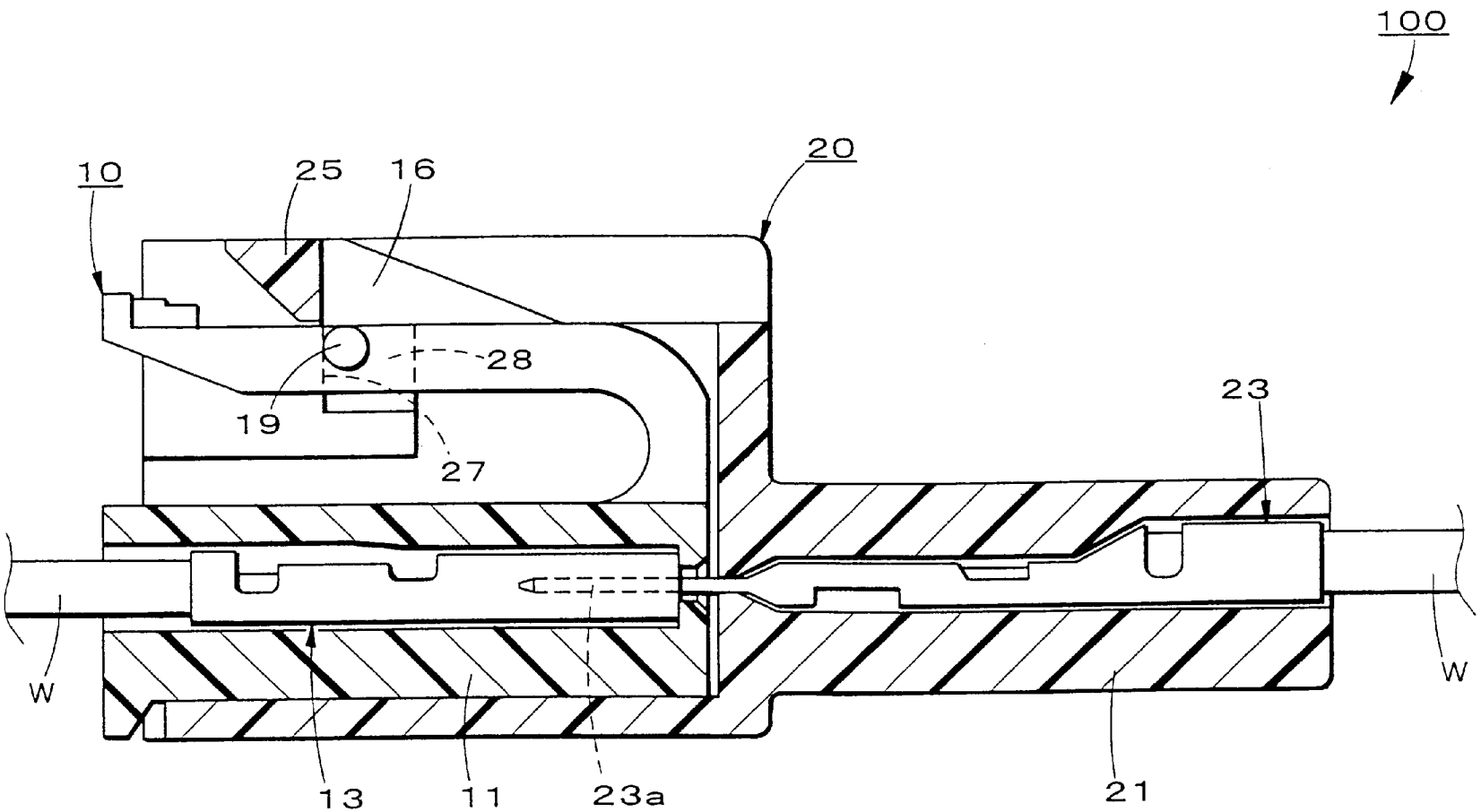
FIG. 6 is a longitudinal sectional view of the connector lock mechanism shown in FIG. 1, showing the complete engagement between the two connectors.
Figure 7:
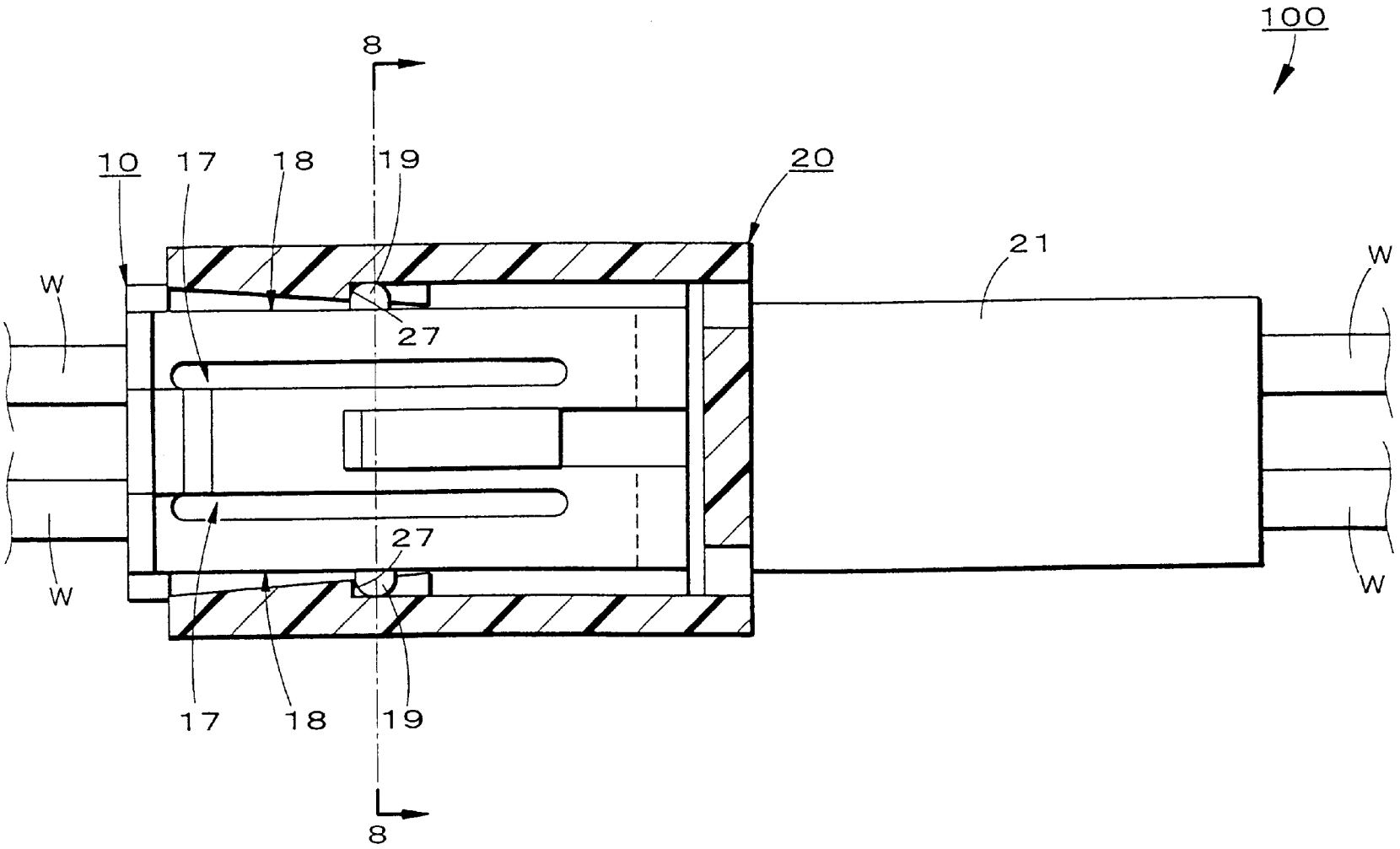
FIG. 7 is a transverse sectional view of the connector lock mechanism shown in FIG. 1, showing the complete engagement between the two connectors shown in FIG. 6.
Figure 8:
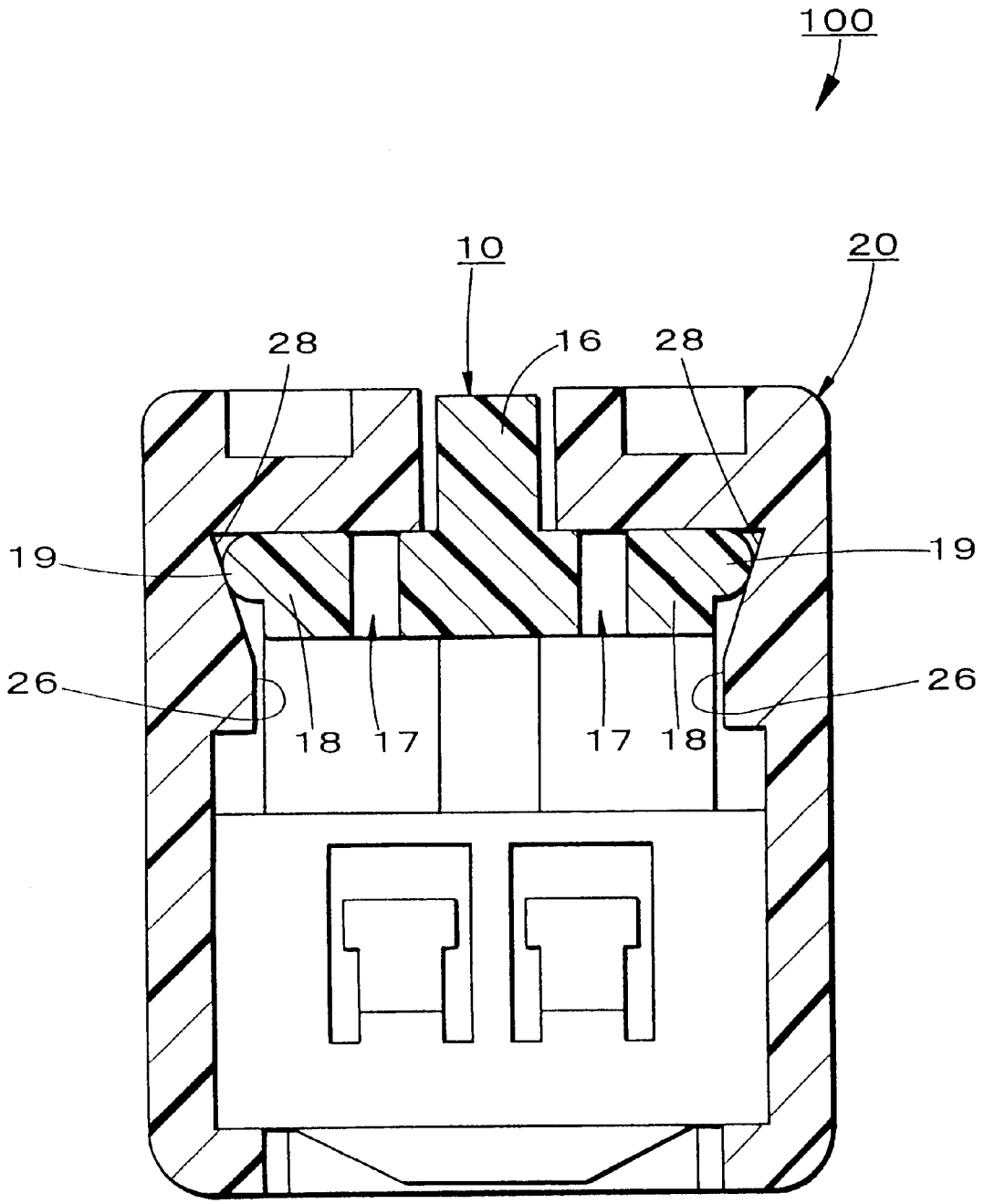
FIG. 8 is a sectional view taken along the line 8—8 shown in FIG. 7.
Figure 9:
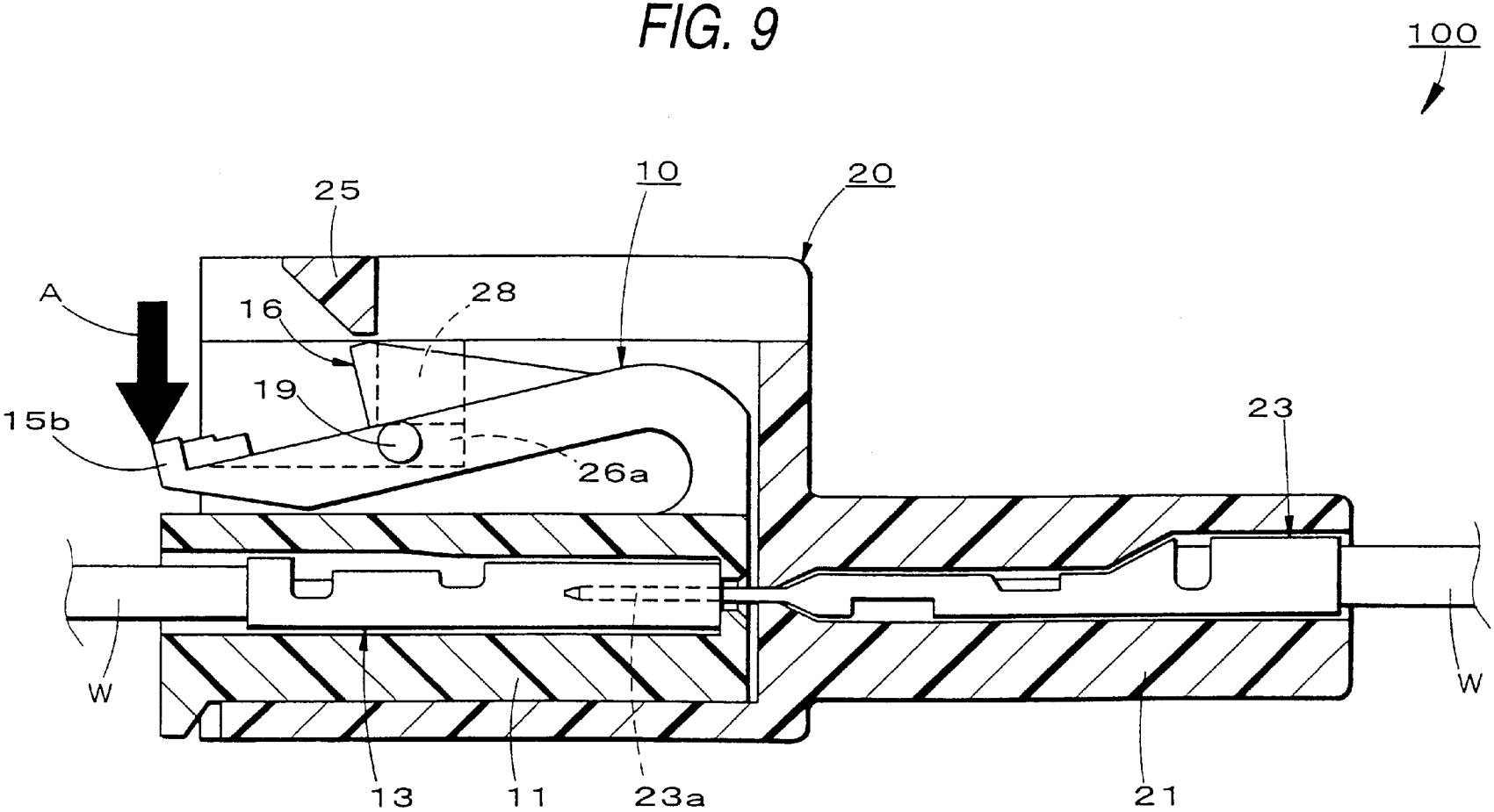
FIG. 9 is a longitudinal sectional view of the first embodiment, showing how to remove the connectors mutual engagement shown in FIG. 6.
Figure 10:
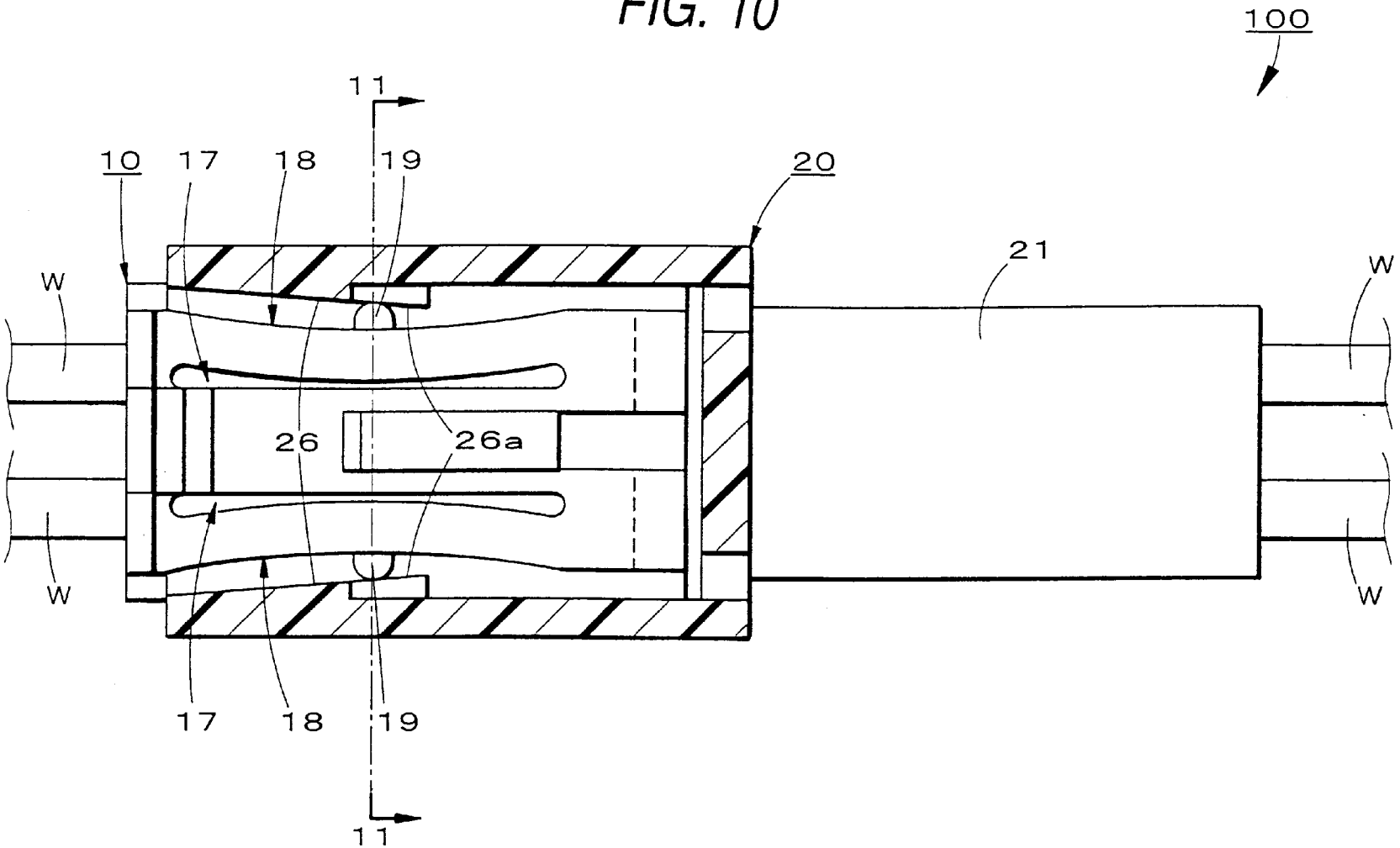
FIG. 10 is a transverse sectional view of the first embodiment, showing how to remove the connectors mutual engagement shown in FIG. 9.
Figure 11:
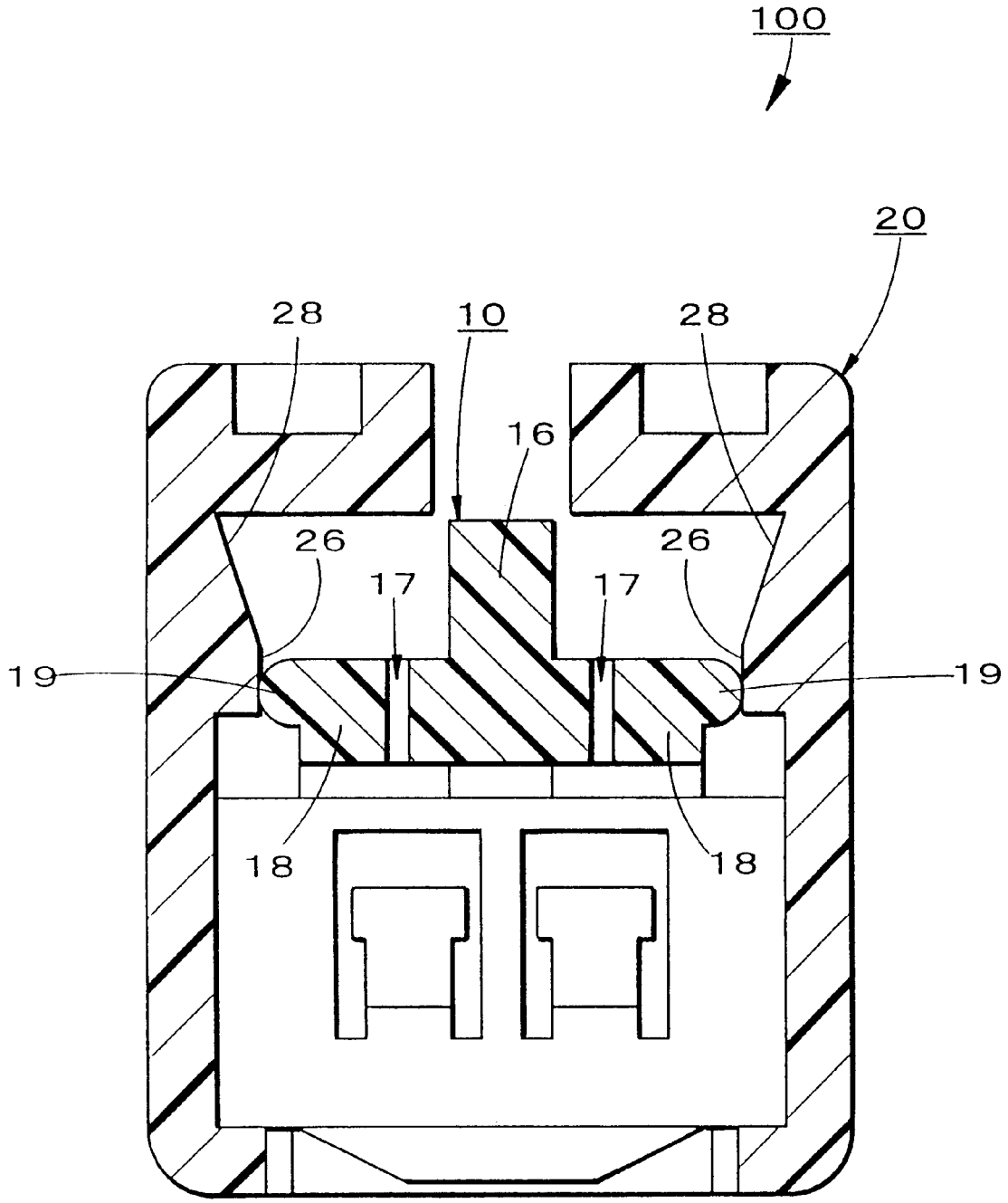
FIG. 11 is a sectional view taken along the line 11—11 shown in FIG. 10.

Now, description will be given below in detail of a first embodiment of a connector lock mechanism according to the invention with reference to FIGS. 1 to 11. Here, FIG. 1 is an exploded perspective view of a first embodiment of a connector lock mechanism according to the invention; FIG. 2 is a longitudinal sectional view of the connector lock mechanism shown in FIG. 1; FIG. 3 is a transverse sectional view of the connector lock mechanism shown in FIG. 1; FIG. 4 is a longitudinal sectional view of the connector lock mechanism shown in FIG. 1, showing the half engagement between the two connectors; FIG. 5 is a transverse sectional view of the connector lock mechanism shown in FIG. 1, showing the half engagement between the two connectors; FIG. 6 is a longitudinal sectional view of the connector lock mechanism shown in FIG. 1, showing the complete engagement between the two connectors; FIG. 7 is a transverse sectional view of the connector lock mechanism shown in FIG. 1, showing the complete engagement between the two connectors; FIG. 8 is a sectional view taken along the line B—B shown in FIG. 7; FIG. 9 is a longitudinal sectional view of the first embodiment, showing how to remove the connectors mutual engagement shown in FIG. 6; FIG. 10 is a transverse sectional view of the first embodiment, showing how to remove the connectors mutual engagement shown in FIG. 6; and, FIG. 11 is a sectional view taken along the line C—C shown in FIG. 10.

As shown in FIGS. 1 to 3, a connector lock mechanism 100 according to the present embodiment is disposed in a pair of male and female connectors 10 and 20 to be engaged with each other.

Referring to the structure of the male connector 10, the male connector includes a housing main body 11 in which there are formed female-type terminal storage chambers 12 in such a manner that they extend through the housing main body 11. Female-type terminals 13, fixed to the terminal end of an electric wire W, are respectively stored within the female-type terminal storage chambers 12.

Also, on the upper surface 11*a* of the housing main body 11, there is provided a flexible arm 15 extending in a direction in which the male connector 10 is inserted into the female connector 20. The flexible arm 15 is structured such that a front end portion 15*a* thereof, that is, an end portion thereof which is located in the front portion thereof when viewed from the insertion direction of the male connector 10, is formed as a cantilever which is fixed to the housing main body 11. The free end 15*b* of the arm 15 can be flexed and shifted on the side approaching the housing main body 11. A securing projection 16 is provided on the upper surface of the flexible arm 15. The securing projection 16 is engageable with a securing portion 25 which is formed on the female connector 20 side, as discussed below. On the insertion-direction forward side of the securing projection 16, there is formed a gently inclined surface 16*a* which slopes down forwardly.

A pair of flexible elastic pieces 18 are provided on the two sides of the flexible arm 15 which respectively extend parallel to the flexible arm 15 with two gaps or spaces 17 therebetween. The pair of flexible elastic pieces 18 include a pair of side surfaces 18*a* and 18*a* which extend in parallel to each other in the male connector insertion direction. In the pair of side surfaces 18*a* and 18*a,* in more particular, in the substantially central portions thereof when viewed in the longitudinal direction thereof, there are provided engaging projections 19 which respectively include substantially hemispherical-shaped leading ends.

On the other hand, referring to the structure of the female connector 20, in the housing main body 21 of the female connector 20, there are formed male-type terminal storage chambers 22 which extend through the housing main body 21. Disposed within the male-type terminal storage chambers 22 are male-type terminals 23 which are fixed to the end of an electric wire W. Also, in the end portion of the female connector 20 that is situated oppositely to the side of the housing main body 21 where the electric wire W extends, there is formed an engagement recess 24 into which the male connector 10 can be engaged or fitted. And, the flat-plate-shaped leading end portions 23*a* of the male terminals 23 are projected into the engagement recess 24.

The above securing portion 25 is located above the engagement recess 24 so as to extend in the insertion direction. The securing portion 25 can be engaged with the above-mentioned securing projection 16 of the flexed arm 15.

Further, in the upper portion of the two inner wall surfaces 24*a* and 24*b* of the engagement recess 24, there are formed a pair of push-out guide surfaces 26 that are symmetrical with respect to the male connector insertion direction. The two push-out guide surfaces 26 are formed such that the distance between them is narrowed toward the forward direction of the male connector insertion direction.

Also, in the forward portions of the push-out guide surfaces 26, there are formed stepped surfaces 27 serving as engaging portions which extend at right angles to the inner wall surfaces 24*a* and 24*b* of the engagement recess 24. Thus, the engaging projections 19 of the flexible arm 15 can be engaged with the stepped surfaces 27 respectively.

Further, the lower-side portions 26*a* of the push-out guide surface 26, which are situated below the stepped surfaces 27, are extended forwardly in the male connector insertion direction beyond the stepped surfaces 27. And, in the extension surfaces 26*a,* there are formed guide surfaces 28 which are disposed in such a manner that they extend upwardly and downwardly in the male connector insertion direction forward portions which are situated forwardly than the stepped surfaces 27. The guide surfaces 28 are formed such that the distance between them is narrowed toward the lower side thereof.

Next, description will be given below of the operation of the above-structured connector lock mechanism 100.

At first, as shown in FIGS. 4 and 5, description will be given here of an engaging operation in which the male connector 10 is fitted or engaged with the female connector 20.

To engage the male connector 10 with the female connector 20, as shown by an arrow A in FIG. 4, the free end 15*b* of the flexible arm 15 is pushed down toward the housing main body 11 side. This prevents mutual interference between the securing projection 16 provided on the flexible arm 15 and the securing portion 25 formed on the female connector 20 side when the male connector 10 is inserted into the female connector 20, so that the two connectors 10 and 20 can be engaged with each other smoothly.

If the downward pressing operation of the free end 15*a* of the flexible arm 15 is stopped while the two connectors 10 and 20 are not engaged together completely, then the gently inclined surface 16*a* of the engaging projection 16 is pressed against the engaging portion 25 due to the elastic force of the flexible arm 15. As a result of this, part of the reactive force of the pressing force with which the gently inclined surface 16 presses against the engaging portion 25 acts in a direction to remove the male connector 10 from the female connector 20.

Therefore, in the connector lock mechanism 100 according to the present embodiment, when the two connectors 10 and 20 are only partially or half engaged, that is, when the engaging projection 16 of the flexible arm 15 is not completely engaged with the securing portion 25, the two connectors 10 and 20 are removed from each other, which makes it possible to surely prevent the incomplete or half engagement between the two connectors 10 and 20.

Also, as shown in FIG. 5, in an intermediate stage of the inserting operation in which the male connector 10 is inserted into the female connector 20, the two engaging projections 19, which are respectively provided on the pair of right and left flexible elastic pieces 18, are allowed to slide on the pair of push-out guide surfaces 26.

As the mutual engagement between the male and female connectors 10 and 20 advances, the distance between the pair of push-out guide surfaces 26 is narrowed. Therefore, the flexible elastic pieces 18 are curved gradually and thus are shifted in position in the width direction of the slits 17. As a result, the pair of flexible elastic pieces 18 press the push-out guide surfaces 26 through the engaging projections 19.

Since the pair of push-out guide surfaces 26 are inclined in the male connector insertion direction, part of the reactive forces of the pressing forces with which the pair of engaging projections 19 press against the push-out guide surfaces 26 acts on the male connector 10 in a direction in which the male connector 10 is removed from the female connector 20.

Therefore, in the connector lock mechanism 100 according to the present embodiment, if the mutual engagement between the two connectors 10 and 20 is insufficient (partial or half engagement), the two connectors 10 and 20 are urged away from each other, which makes it possible to surely prevent the incomplete or half engagement between the two connectors 10 and 20.

Next, description will be given below of the completely engaged condition between the male and female connectors 10 and 20 with reference to FIGS. 6 to 8.

As shown in FIG. 6, in a state where the male and female connectors 10 and 20 are engaged together completely, the securing projection 16 of the flexible arm 15 is engaged with the securing portion 25. At the same time, as shown in FIG. 7, the pair of engaging projections 19 are engaged with the pair of stepped surfaces 27 while the pair of engaging projections 19 are disposed on the pair of guide surfaces 28.

Therefore, the mutual engagement between the male and female connectors 10 and 20 is locked positively. In this locked condition, since the female-type terminals 13 and male-type terminals 23 are contacted with each other positively, the electric wires can be positively connected together electrically.

Next, description will be given below of an operation in which the male connector 10 is removed from the female connector 20 with reference to FIGS. 9 to 11.

As shown in FIG. 9, to remove the male connector 10 from the female connector 20, as shown by an arrow A in FIG. 9, if the free end 15*b* of the flexible arm 15 is pressed down and is thereby shifted toward the housing main body 11 side, then the engagement between the securing projection 16 of the flexible arm 15 and the securing portion 25 of the female connector 20 can be removed.

In the above operation, the pair of engaging projections 19 are respectively slid on their respective guide surfaces 28 downwardly in FIG. 9 as the flexible arm 15 is flexed toward the housing main body 11 so that, as shown in FIGS. 10 and 11, they climb up onto their associated extension portions 26*a* and 26*a* of the push-out guide surfaces 26. That is, in the connector lock mechanism 100 according to the present embodiment, the mutual engagement between the pair of engaging projections 19 and the pair of guide surfaces 28 is removed simultaneously when the flexible arm 15 is flexed and shifted in position.

When the pair of engaging projections 19 climb up onto their associated extension portions 26*a* and 26*a* of the push-out guide surfaces 26, a component of the reactive force acts in a direction which causes the male connector 10 to be removed from the female connector 20. That is, in the connector lock mechanism 100 according to the present embodiment, even in a state where the flexible arm 15 is flexed and shifted in position, there is a removing force which removes the male connector 10 from the female connector 20.

Therefore, with use of the connector lock mechanism 100 according to the present embodiment, an operation to remove the male connector 10 from the female connector 20 can be carried out easily.

Figure 12:
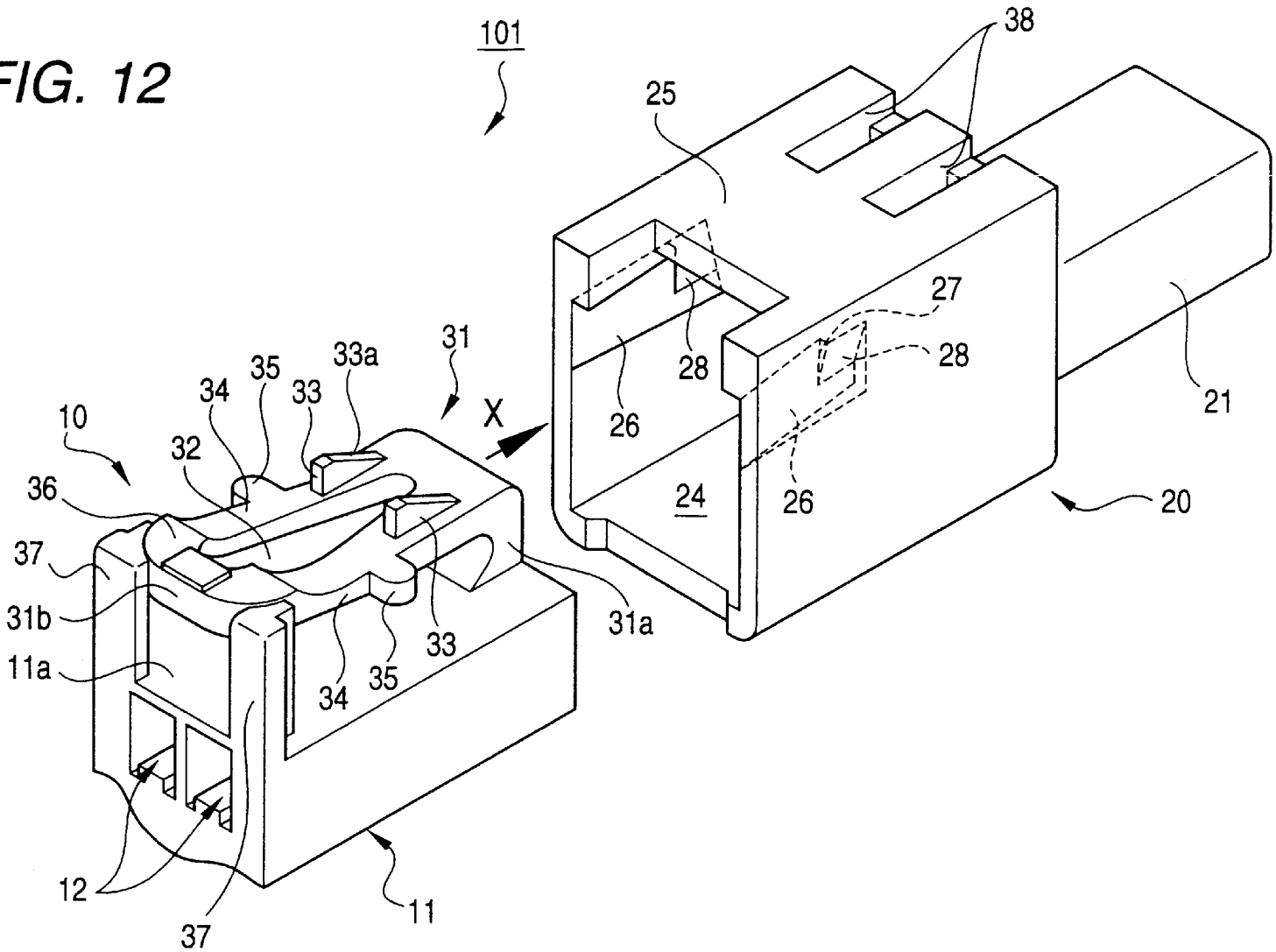
FIG. 12 is an exploded perspective view of a second embodiment of a connector lock mechanism according to the invention.
Figure 13:
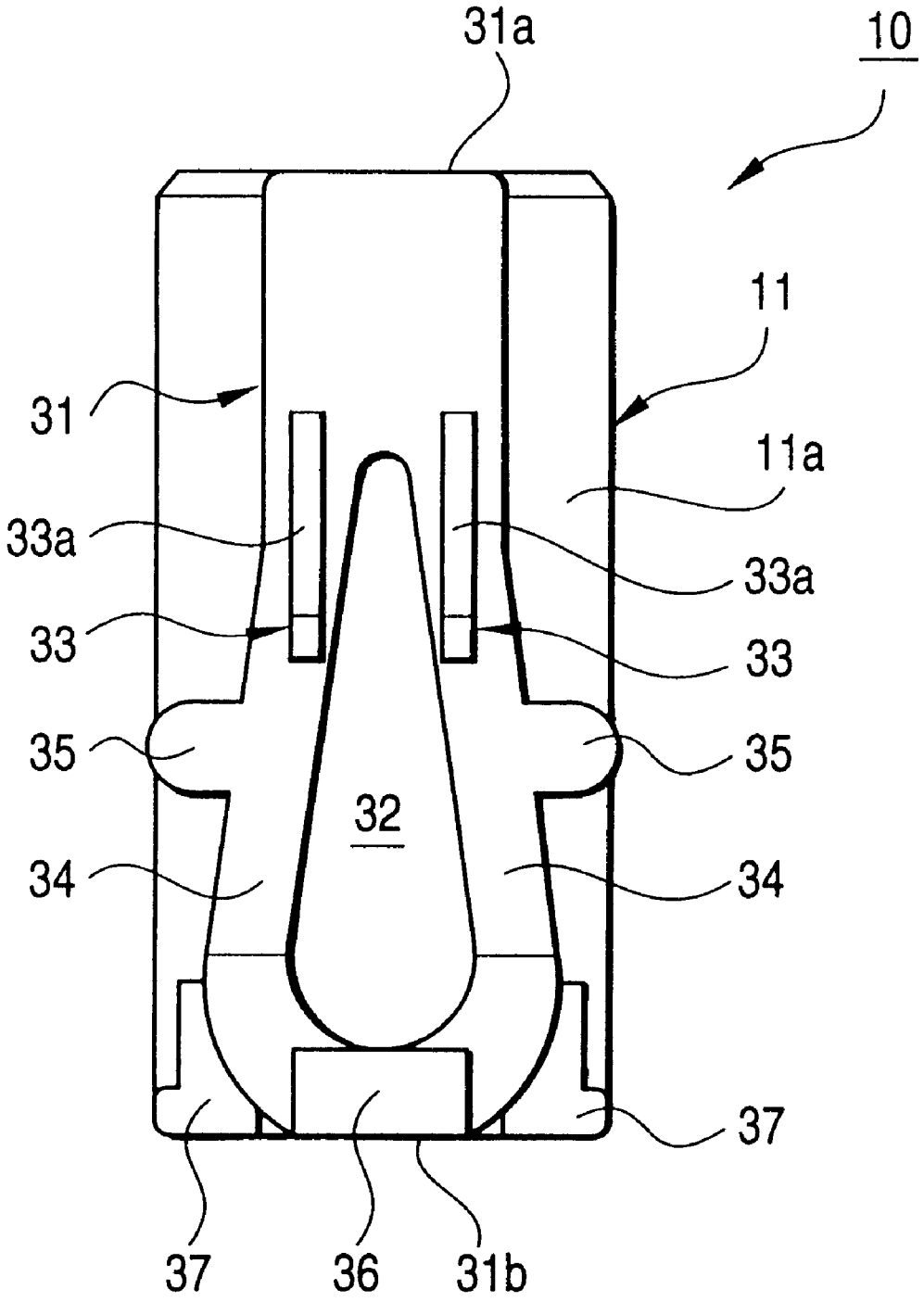
FIG. 13 is a plan view of a male connector shown in FIG. 12.
Figure 14:
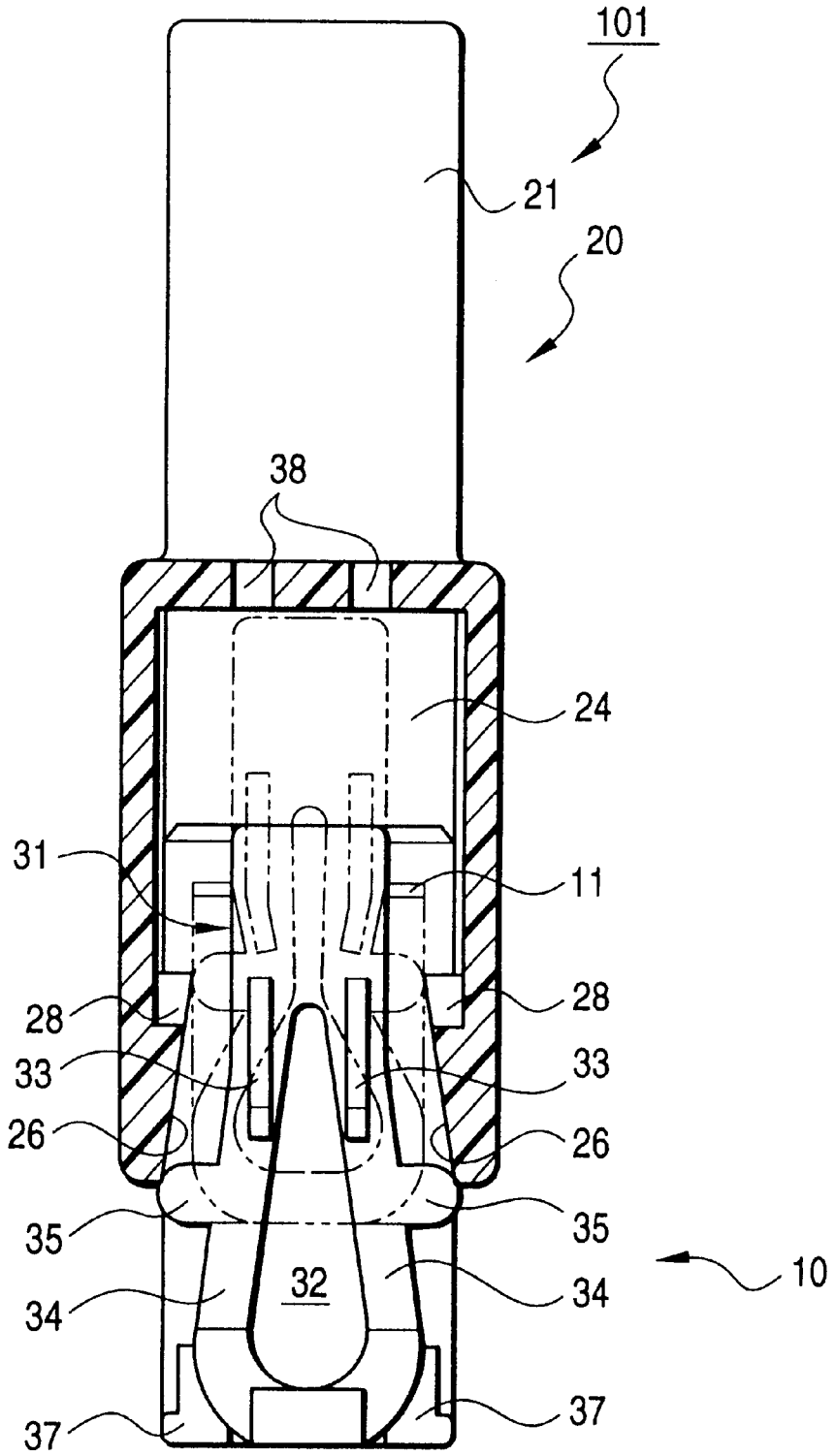
FIG. 14 is a partially cutaway plan view of the engaging operation to be executed between the male and female connectors shown in FIG. 12.
Figure 15:
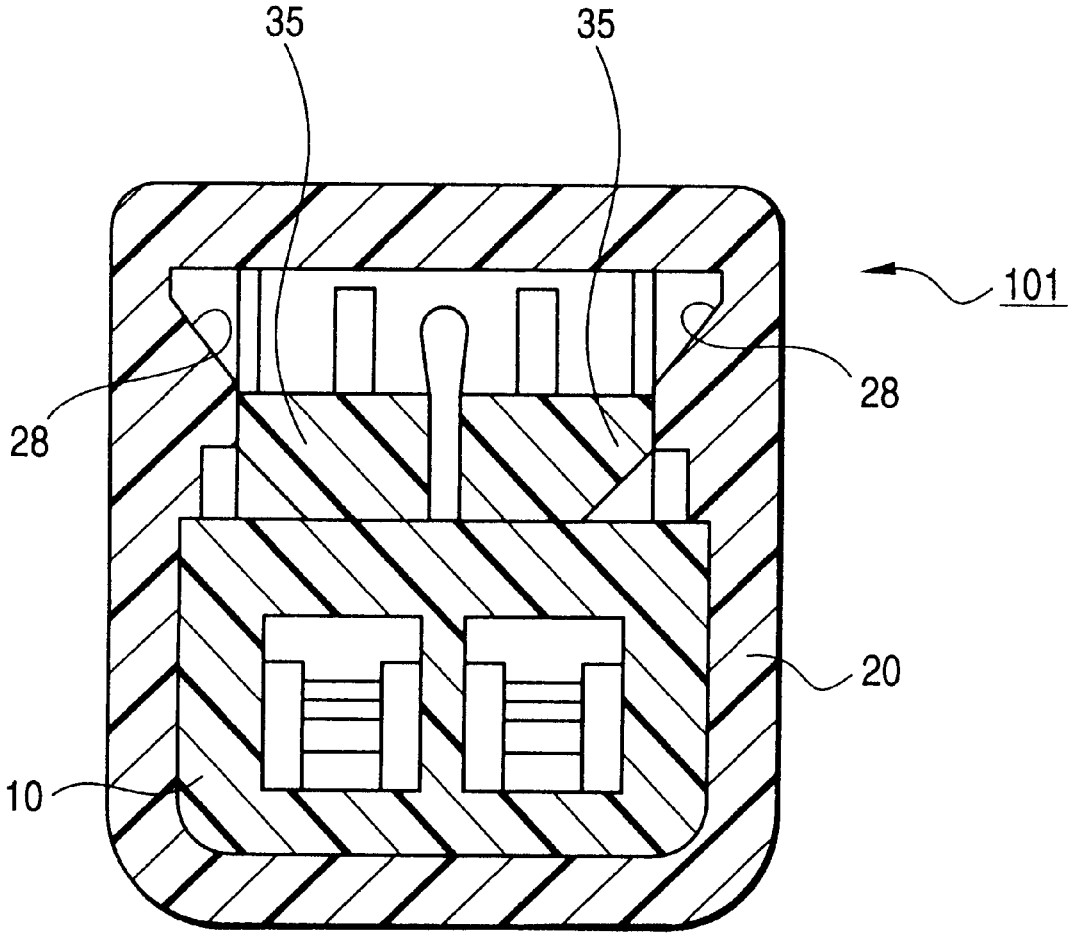
FIG. 15 is a transverse sectional view of the connector lock mechanism according to the second embodiment, showing the half engagement between the male and female connectors.
Figure 16:
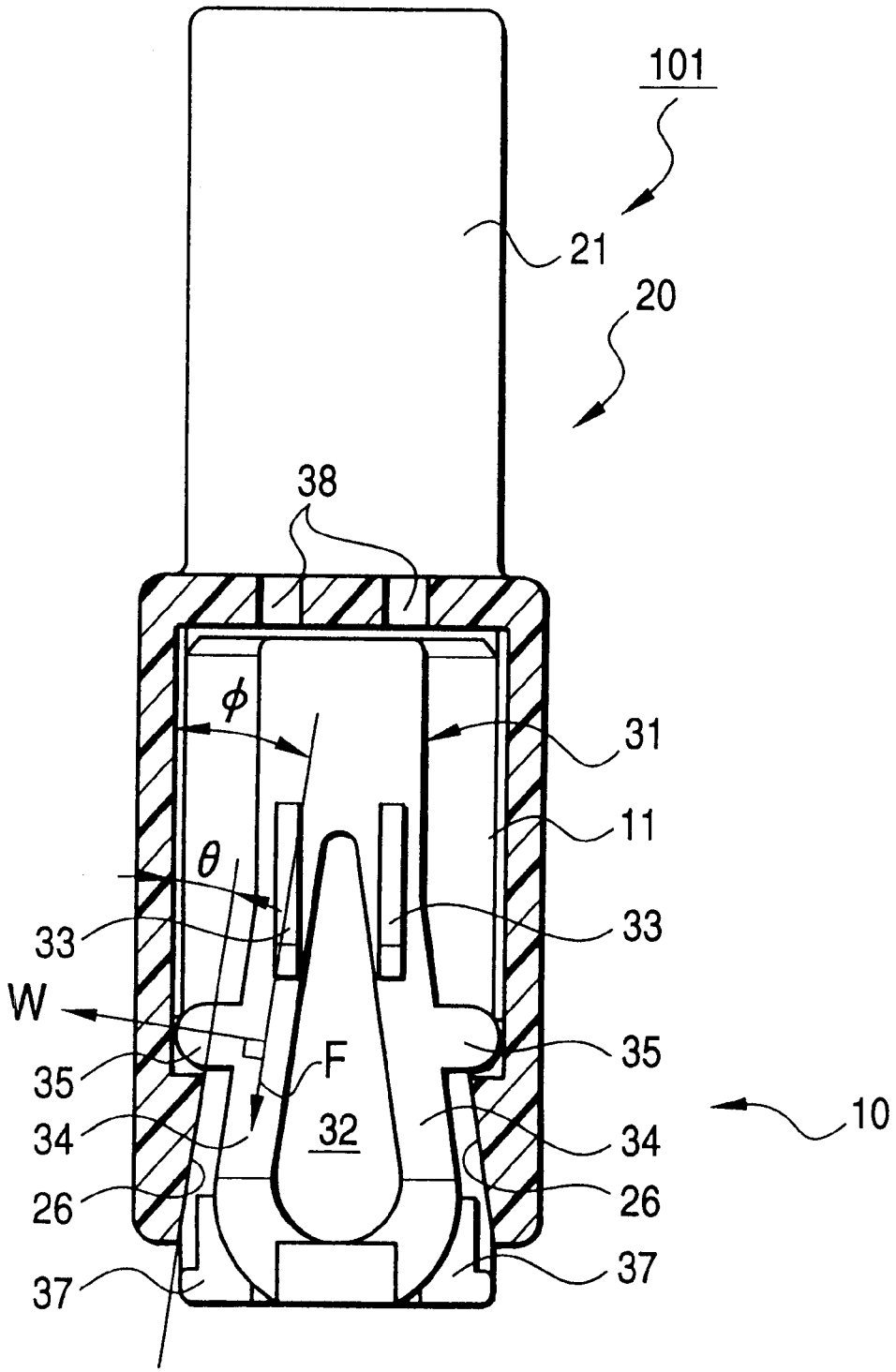
FIG. 16 is a partially cutaway plan view of the second embodiment, showing the mutual engagement between the male and female connectors shown in FIG. 12 and a removing force.
Figure 17:
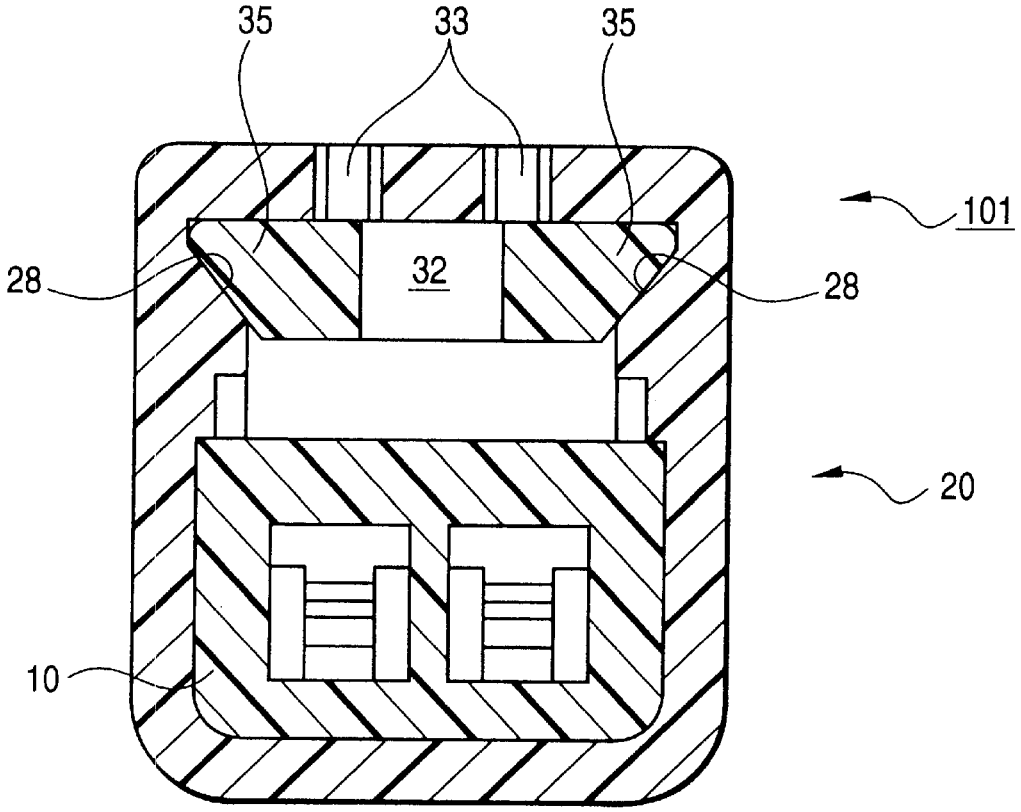
FIG. 17 is a transverse sectional view of the connector lock mechanism according to the second embodiment, showing the mutual engagement between the male and female connectors shown in FIG. 16.
Figure 18:
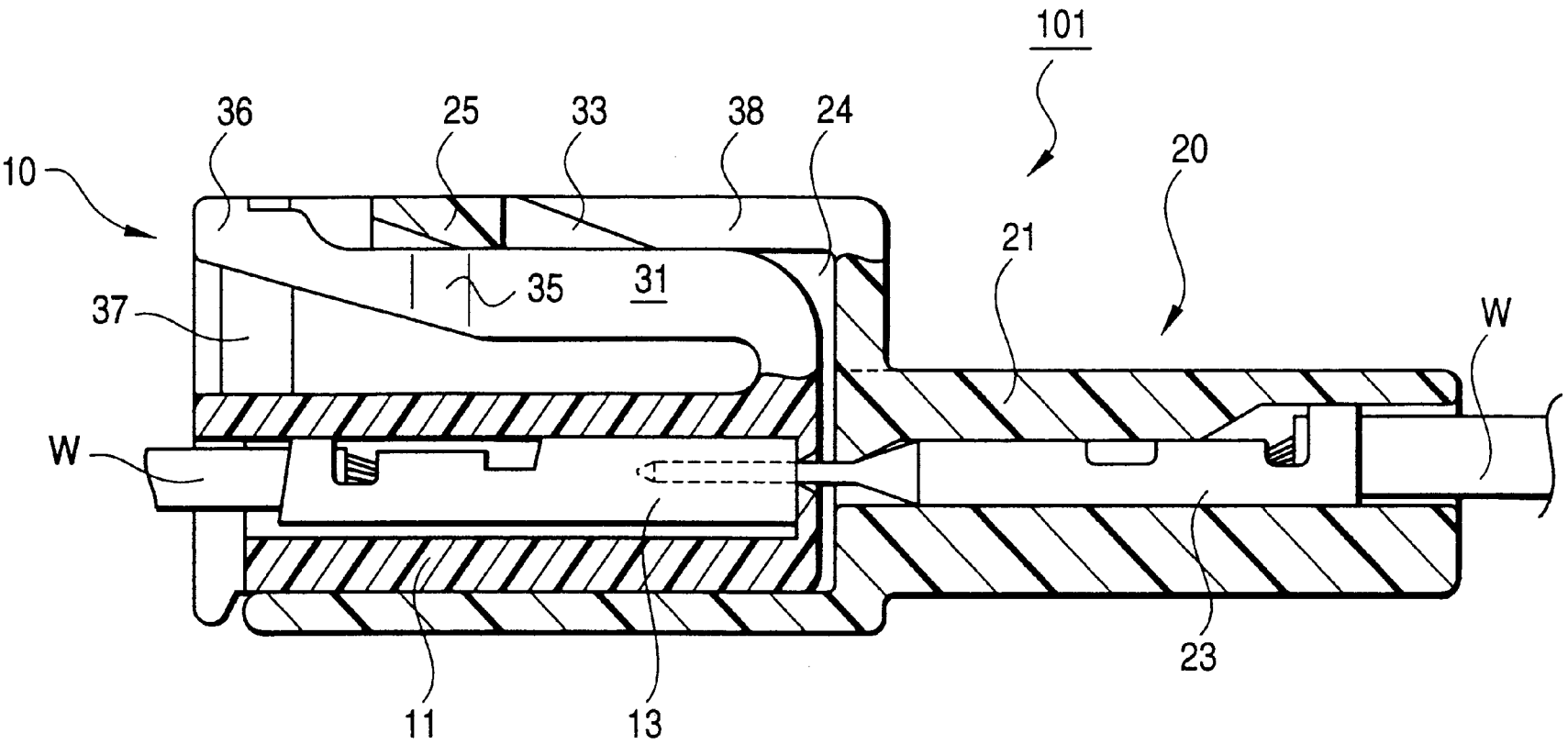
FIG. 18 is a longitudinal sectional view of the connector lock mechanism according to the second embodiment, showing the mutual complete engagement between the male and female connectors shown in FIG. 16.
Figure 19:
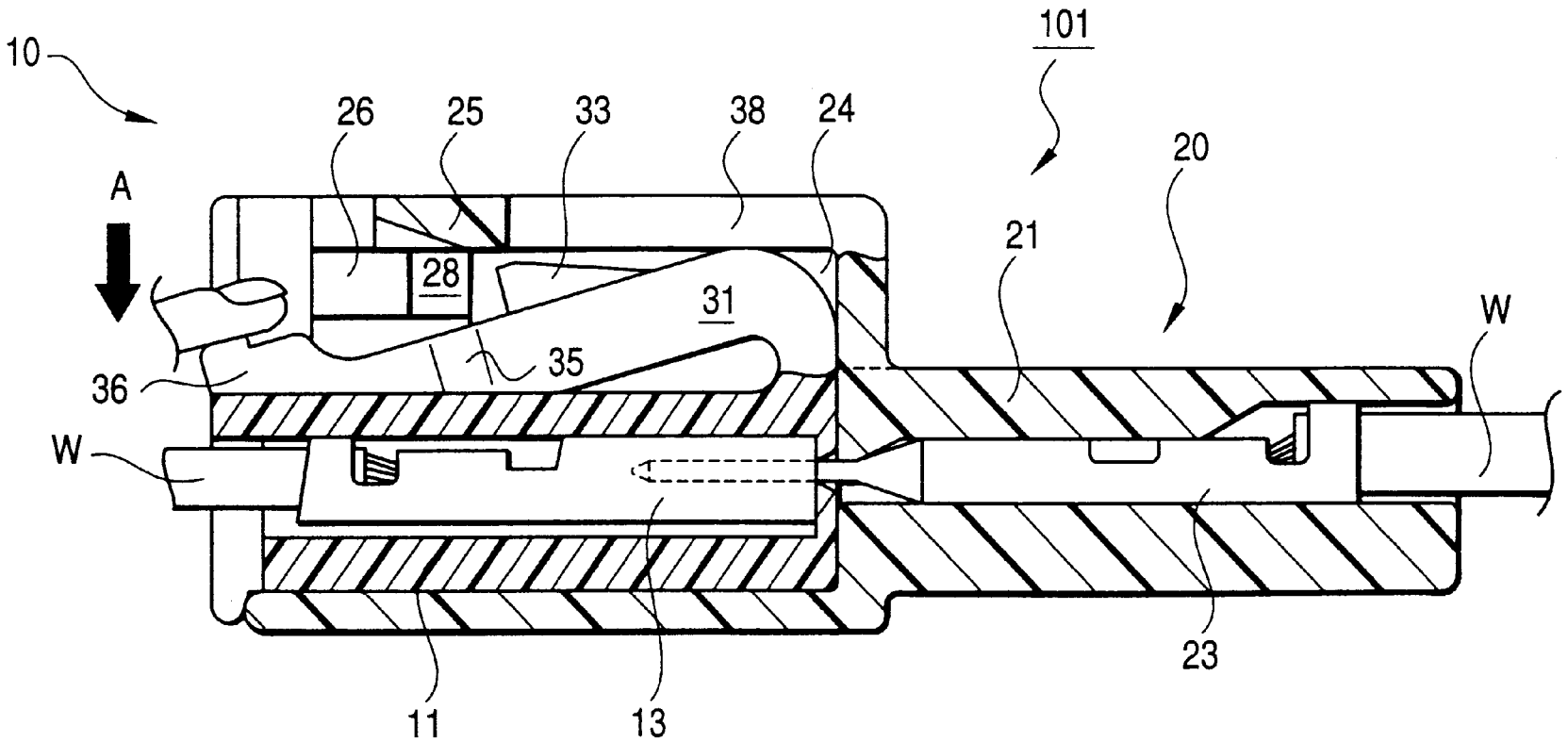
FIG. 19 is a longitudinal sectional view of the connector lock mechanism according to the second embodiment, showing how to remove the mutual engagement between the male and female connectors shown in FIG. 18.

Now, description will be given below in detail of a second embodiment of a connector lock mechanism according to the invention with reference to FIGS. 12 to 19. In particular, FIG. 12 is an exploded perspective view of the second embodiment of a connector lock mechanism according to the invention; FIG. 13 is a plan view of a male connector employed in the second embodiment, showing the structure thereof; FIG. 14 is a partially cutaway plan view of the second embodiment, showing the mutual engagement between the male and female connectors employed therein; FIG. 15 is a transverse sectional view of the connector lock mechanism according to the second embodiment, showing the mutual engagement between the male and female connectors; FIG. 16 is a partially cutaway plan view of the second embodiment, showing the mutual complete engagement between the male and female connectors; FIG. 17 is a transverse sectional view of the connector lock mechanism according to the second embodiment, showing the mutual complete engagement between the male and female connectors shown in FIG. 16; FIG. 18 is a longitudinal sectional view of the connector lock mechanism according to the second embodiment, showing the mutual complete engagement between the male and female connectors; and, FIG. 19 is a longitudinal sectional view of the connector lock mechanism according to the second embodiment, showing how to remove the mutual engagement between the male and female connectors.

The second embodiment differs from the first embodiment mainly in the structure of a flexible arm. Therefore, in the following description of the second embodiment and drawings associated with the second embodiment, the drawings and reference characters referred to in the first embodiment are used properly and thus the duplicated description thereof is omitted here.

Now, a connector lock mechanism 101 according to the second embodiment shown in FIG. 12 relates to a set of male and female connectors 10 and 20 to be engaged with each other. In a housing main body 11 forming the male connector 10, there are formed a pair of female-type terminal storage chambers 12 in such a manner that they respectively extend through the interior portion of the housing main body 11. In the respective female-type terminal storage chambers 12, as shown in FIG. 18, there are stored their associated female-type terminals 13 which are fixed to the end portion of an electric wire W. Also, on the upper surface 11*a* of the housing main body 11, there is provided a flexible arm 31 that extends in a direction in which the male connector 10 is inserted into the female connector 20.

The flexible arm 31 is formed as a cantilever which has a front end portion 31*a* fixed to the housing main body 11, whereas its free end portion 31*b* can be flexed and deformed toward the housing main body 11. Also, the flexible arm 31 is structured as shown in FIG. 13 so that the width thereof on the front end portion 31*a* is greater than the width thereof on the free end portion 31*b*. Further, in the central portion of the flexible arm 31, there is formed a space 32 which serves as a flexing space. Also, a pair of securing projections 33 are provided at the positions of the flexible arm 31 that respectively lie on the upper surface of the flexible arm 31 and correspond to the two sides of the space 32, which can be secured to a securing portion 25 formed on the female connector 20 side. In the respective forward portions of the two securing projections 33, there are formed gently inclined surfaces 33*a* which respectively descend forwardly.

Also, on the two side portions of the flexible arm 31, there are provided a pair of flexible elastic pieces 34 which extend obliquely with respect to the connector engaging direction. The flexible elastic pieces 34 are structured such that they can be flexed and deformed in the inside direction of the space 32 and also can be elastically returned back to their original positions. Also, engaging projections 35 are provided on the respective outer surfaces of the two flexible elastic pieces 34. The engaging projections 35 are formed as substantially semispherical shapes respectively projecting outwardly.

As shown in FIG. 18, the lower surface side of the flexible arm 31 is gradually thinned at and from the neighboring portions of the provision positions of the engaging projections 35 toward the direction of the free end portion 31*b*. In the upper portion of the free end portion 31*b*, there is formed an operation portion 36, which makes it easy for an operator to put his or her finger on the free end portion 31*b* when flexing the whole of the flexible arm 31.

Also, the free end portion 31*b* includes two arc-shaped corner portions formed on the rear end side thereof which are surrounded by two guide members 37 which are respectively erected on the upper surface 11*a* of the housing main body 11. The corner portions function as protecting members which prevent interference between the guide members 37 and other members when pressing down the free end portion 31*b*.

On the other hand, referring to the structure of the female connector 20, in the housing main body 21 thereof, there are formed male-type terminal storage chambers which extend through the housing main body 21. In the respective interior portions of the male-type terminal storage chambers, as shown in FIG. 18, there are stored male-type terminals 23 which are respectively fixed to the end portion of an electric wire W. Also, in the forward portion of the housing main body 21, there is formed an engagement recess 24 into which the male connector 10 can be fitted or engaged, while the leading end portions of the male-type terminals 23 are respectively projected into the engagement recess 24. Above the engagement recess 24 is formed the above-mentioned securing portion 25 which extends in the insertion direction and which can be secured to the above-mentioned securing projections of the flexible arm 31. In the forward portion of the securing portion 25, there are formed two engaging grooves 38 into which the pair of securing projections 33 can be engaged respectively.

It is noted that the push-out guide surfaces 26, stepped surfaces 27 and guide surfaces 28 are the same in structure as those employed in the previously described first embodiment (see FIG. 1(*b*)).

Description will be given below of the deflection of the flexible arm 31 in the lateral direction thereof with reference to FIGS. 14 and 15. As shown in FIG. 14, if the entire male connector 10 is pushed into the engagement recess 24, then the two engaging projections 35 respectively formed on the outside portions of the pair of flexible elastic pieces 34 are contacted with the respective front end portions of the two push-out guide surfaces 26. Because the distance between the two push-out guide surfaces 26 is gradually narrowed, as the male connector 10 is pushed in further, then the pair of flexible elastic pieces 34 are respectively deformed in their inward directions, that is, they are deformed in such a manner as to narrow the space 32 from both sides.

When pushing in the male connector 10, the flexible arm 31 is still deflected toward the housing main body 11, so that the flexible arm 31 remains shifted toward the housing main body 11. Therefore, in a stage in which the male connector 10 is pushed from a state thereof shown by a solid line in FIG. 14 to a state thereof shown by an imaginary line shown in FIG. 14, the engaging projections 35 maintain their shifted positions. Accordingly, the engaging projections 35 are respectively situated below their associated guide surfaces 28.

In a condition where the two connectors 10 and 20 are not engaged with each other completely, if the pressing operation of the free end portion 31*a* of the flexible arm 31 is stopped, then the gently inclined surfaces 33*a* of the securing projections 33 are respectively pressed against the securing portion 25 due to the elasticity of the flexible arm 31. As a result of this, a component of the reactive force of the pressing force of the gently inclined surfaces 33*a* against the securing portion 25 acts in such a manner as to remove the male connector 10 from the female connector 20. Therefore, when the mutual engagement between the two connectors 10 and 20 is half engagement, that is, when the securing projections 33 of the flexible arm 31 are not engaged with the securing portion 25 completely, the two connectors 10 and 20 are urged away from each other, which makes it possible to surely prevent occurrence of the incomplete or half engagement between the two connectors 10 and 20.

Next, description will be given below of the operation of the above-structured connector lock mechanism 101.

At first, referring to an operation for mutual engagement between the male and female connectors 10 and 20, when engaging the male connector 10 with the female connector 20, similarly to the first embodiment, the free end portion 31*b* of the flexible arm 31 is pushed downward and is thereby shifted toward the housing main body 11. Therefore, without causing mutual interference between the securing projections 33 of the flexible arm 31 and the securing portion 25 of the female connector 20, the male connector 10 can be inserted into the female connector 20 so that the male and female connectors 10 and 20 can be engaged with each other.

In a state where the two connectors 10 and 20 are not engaged with each other completely, if the pressing operation of the free end portion 31*a* of the flexible arm 31 is stopped, then the gently inclined surfaces 33*a* of the securing projections 33 are respectively pressed against the securing portion 25 of the female connector 20 due to the elastic force of the flexible arm 31. As a result, a component of the pressing force of the gently inclined surfaces 33*a* against the securing portion 25 acts in a direction to remove the male connector 10 from the female connector 20.

Therefore, when the two connectors 10 and 20 are engaged with each other in a half engaged condition in which the securing projections 33 of the flexible arm 31 are not engaged with the securing portion 25 of the female connector 20, the two connectors 10 and 20 are removed from each other, which makes it possible to surely prevent occurrence of the incomplete or half engagement between the two connectors 10 and 20.

Also, in an intermediate engagement stage in which the male connector 10 is inserted into the female connector 20, as shown in FIGS. 14 and 15, the pair of engaging projections 35 respectively provided on the outside surfaces of the pair of flexible elastic pieces 34 are respectively allowed to slide on the pair of push-out guide surfaces 26. And, as the mutual engagement between the two connectors 10 and 20 advances, the distance between the push-out guide surfaces 26 is narrowed, so that the flexible elastic pieces 34 are gradually curved in such directions as to narrow the space 32. As a result, there is generated a repulsive force to return the flexible elastic pieces 34 to their respective original positions, so that the engaging projections are respectively pressed against their associated push-out guide surfaces 26.

The pair of push-out guide surfaces 26, as shown in FIGS. 14 and 16, are respectively inclined with respect to the male connector insertion direction. For this reason, a component of the repulsive force of the pair of engaging projections 35 against the push-out guide surfaces 26 acts to push out the male connector 10 in a direction to remove the same from the female connector 20. In this manner, if the mutual engagement between the two connectors 10 and 20 is insufficient or half engagement, the two connectors 10 and 20 are urged away from each other, which makes it possible to surely prevent occurrence of the incomplete or half engagement between the two connectors 10 and 20.

Next, description will be given below of the complete engagement between the male and female connectors 10 and 20 with reference to FIGS. 16 to 18.

As shown in FIG. 16, in a state where the male and female connectors 10 and 20 are engaged with each other completely, the securing projections of the flexible arm 31 are secured to the securing portion 25 of the female connector 20 in such a manner as shown in FIG. 18 and are thereby fitted or engaged into their associated engaging grooves 38. At this time, as shown in FIG. 17, the pair of engaging projections 35 are respectively engaged with the pair of stepped surfaces 27 (engaging portions) and disposed on the pair of guide surfaces 28.

Due to this, the male connector 10 can be positively engaged with the female connector 20 in a removal preventive manner, so that the female-type terminals 13 and male-type terminals 23 can be connected with each other electrically.

Next, description will be given below of an operation to remove the male connector 10 from the female connector 20 with reference to FIG. 19. As shown by arrow A in FIG. 19, when removing the male connector 10 from the female connector 20, if the operation portion 36 of the flexible arm 31 is pressed downward with a finger or the like and is thereby shifted toward the housing main body 11, then the engagement between the securing projections 33 of the flexible arm 31 and the securing portion 25 of the female connector 20 is removed.

At this time, the pair of engaging projections 35 are allowed to slide on their associated guide surfaces 28 downwardly in FIG. 19 as the flexible arm 31 is flexed and shifted toward the housing main body 11, so that the engaging projections 35 climb onto the extension portions 26*a* and 26*a* (see FIG. 1) of the push-out guide surfaces 26, respectively. That is, simultaneously to when the flexible arm 31 is flexed and shifted, the engagement between the pair of engaging projections 35 and the pair of stepped surfaces 28 can be removed.

Also, if the pair of engaging projections 35 climb onto the extension portions 26*a* and 26*a* of the push-out guide surfaces 26, then a component of the repulsive force, with which the pair of flexible elastic pieces 34 press the extension portions 26*a* of the push-out guide surfaces 26 through the engaging projections 35, acts in a direction to remove the male connector 10 from the female connector 20. That is, in a state where the flexible arm 31 is flexed and shifted, there is generated a removing force which removes the male connector 10 from the female connector 20.

Therefore, with the use of the connector lock mechanism 101 according to the present embodiment, the operation to remove the male connector 10 from the female connector 20 can be carried out easily.

By the way, in the connector lock mechanism 101 according to the present embodiment, to remove the male connector 10 from the female connector 20 smoothly and positively, there is employed the following structure. That is, as shown in FIG. 16, assuming that the inclination angle of each of the push-out guide surfaces 26 formed in the female connector 20 is expressed as $\theta$, the inclination angle of each of the pair of flexible elastic pieces 34 is expressed as $\phi$, and a force with which the engaging projections 35 press against the guide surfaces 26 outwardly due to the elasticity of the pair of flexible elastic pieces 34 is expressed as W, then a removing force F which pushes out the male connector 10 outwardly when removing the male connector 10 from the female connector 20 can be obtained from an equation, W $\tan(\phi-\theta)$.

Here, in an operation to remove the male and female connectors 10 and 20 from each other, the pair of flexible elastic pieces 34 and engaging projections 35, which are held in the state shown in FIG. 16, are deformed into the state shown by an imaginary line in FIG. 14. Therefore, while the inclination angle $\theta$ of the push-out guide surfaces 26 remain constant, the inclination angle $\phi$ of the flexible elastic pieces 34 increases due to the deformation of the pair of flexible elastic pieces 34, thereby increasing the removing force F which pushes out the male connector 10 toward the opening of the female connector 20.

Based on the foregoing, in the connector lock mechanism 101 according to the present embodiment, when removing the engagement of the male connector 10 with respect to the female connector 20 to thereby separate the male connector 10 from the female connector 20, the removing operation can be executed with a small force. Conventionally, in the connectors of this type, if the number of female-type and male-type terminals 13 and 23 increases, then there is required a large force to remove the male connector 10 from the female connector 20. However, according to the present embodiment, since the removing force F increases suddenly due to the deformation of the pair of flexible elastic pieces 34, the mutual engagement between the male and female connectors 10 and 20 can be removed smoothly.

Figure 20:
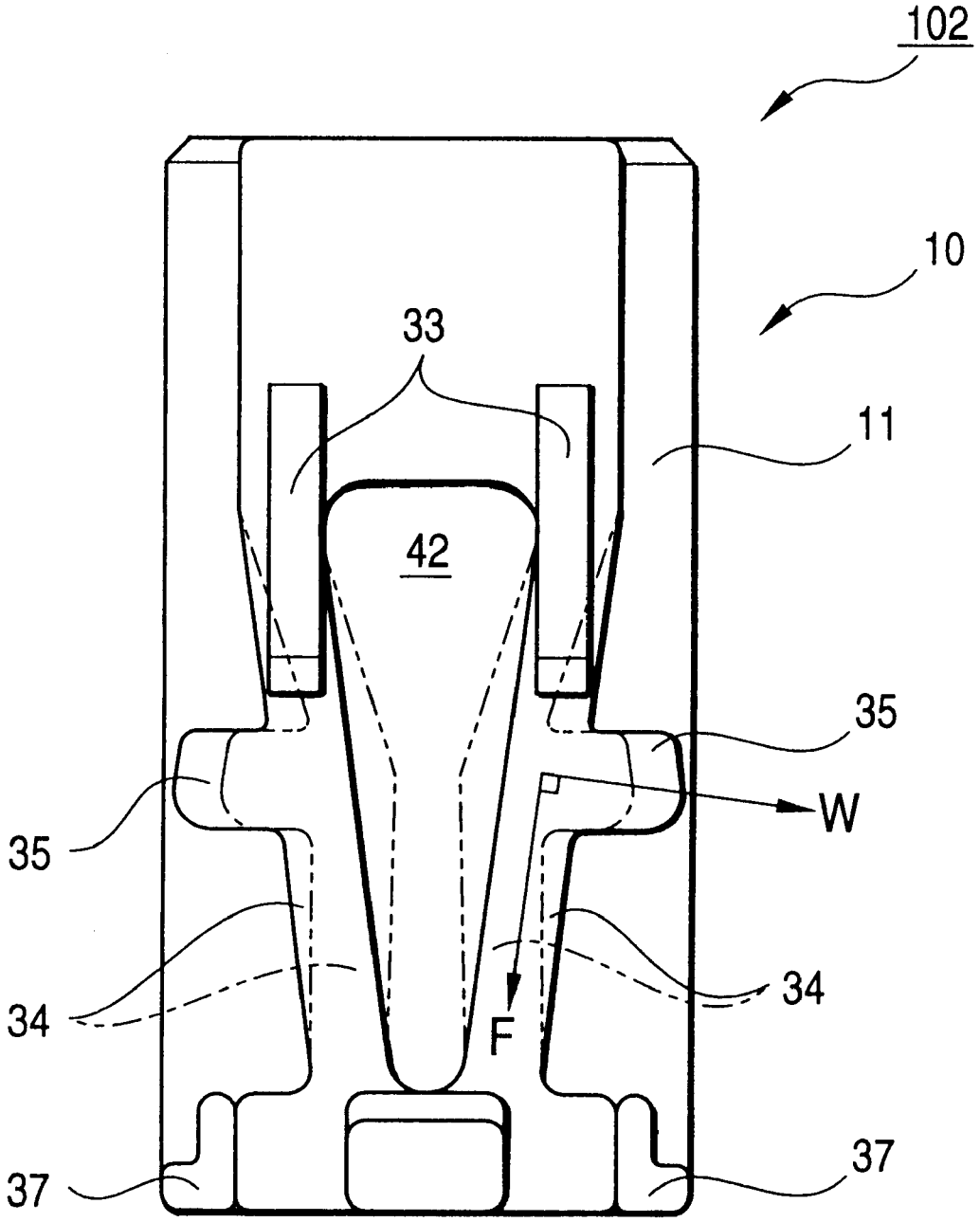
FIG. 20 is a plan view of a third embodiment of a connector lock mechanism according to the invention, showing mainly a male connector thereof.

Next, description will be given below in detail of a third embodiment of a connector lock mechanism according to the invention with reference to FIG. 20. FIG. 20 is a plan view of the structure of a male connector, showing the third embodiment of the invention.

The third embodiment is different from the previously described second embodiment mainly in that the space formed in the flexible arm is changed. Therefore, in the third embodiment, the same parts thereof as those in the previously described first embodiment are given the same designations and thus the detailed description thereof is omitted here.

As shown in FIG. 20, in a connector lock mechanism 102 according to the third embodiment, a space 42 is formed in the flexible arm 31 in such a manner that, in contrast to the second embodiment, the width thereof is set narrower on the rear end side of the flexible arm 31; that is, narrower in the male connector pull-out or removing direction, while the width of the space 42 increases gradually toward the front end side thereof. Therefore, when inserting the male connector 10 into the female connector 20, while a pair of flexible elastic pieces 34 are being deformed from their respective positions shown by solid lines in FIG. 20 toward the space 42 as shown by imaginary lines in FIG. 20, an operation for mutual engagement between the male and female connectors 10 and 20 can be executed.

Also, when removing the male connector 10 from the female connector 20, since the operation portion 36 is pressed downward similarly to the first embodiment, the pair of flexible elastic pieces 34 are respectively deformed toward the space 42 from their positions shown by the solid lines to their positions shown by the imaginary lines, allowing the removal of the male connector 10 from the female connector 20. In this male connector removing operation, although the two engaging projections 35 contact the push-out guide surfaces 26 (not shown) as the pair of flexible elastic pieces 34 are deformed, in the present embodiment as well, the removing force F increases, so that the male connector 10 can be easily pushed out from the female connector 20. That is, the mutual engagement between the male and female connectors 10 and 20 can be removed easily.

Figure 21:
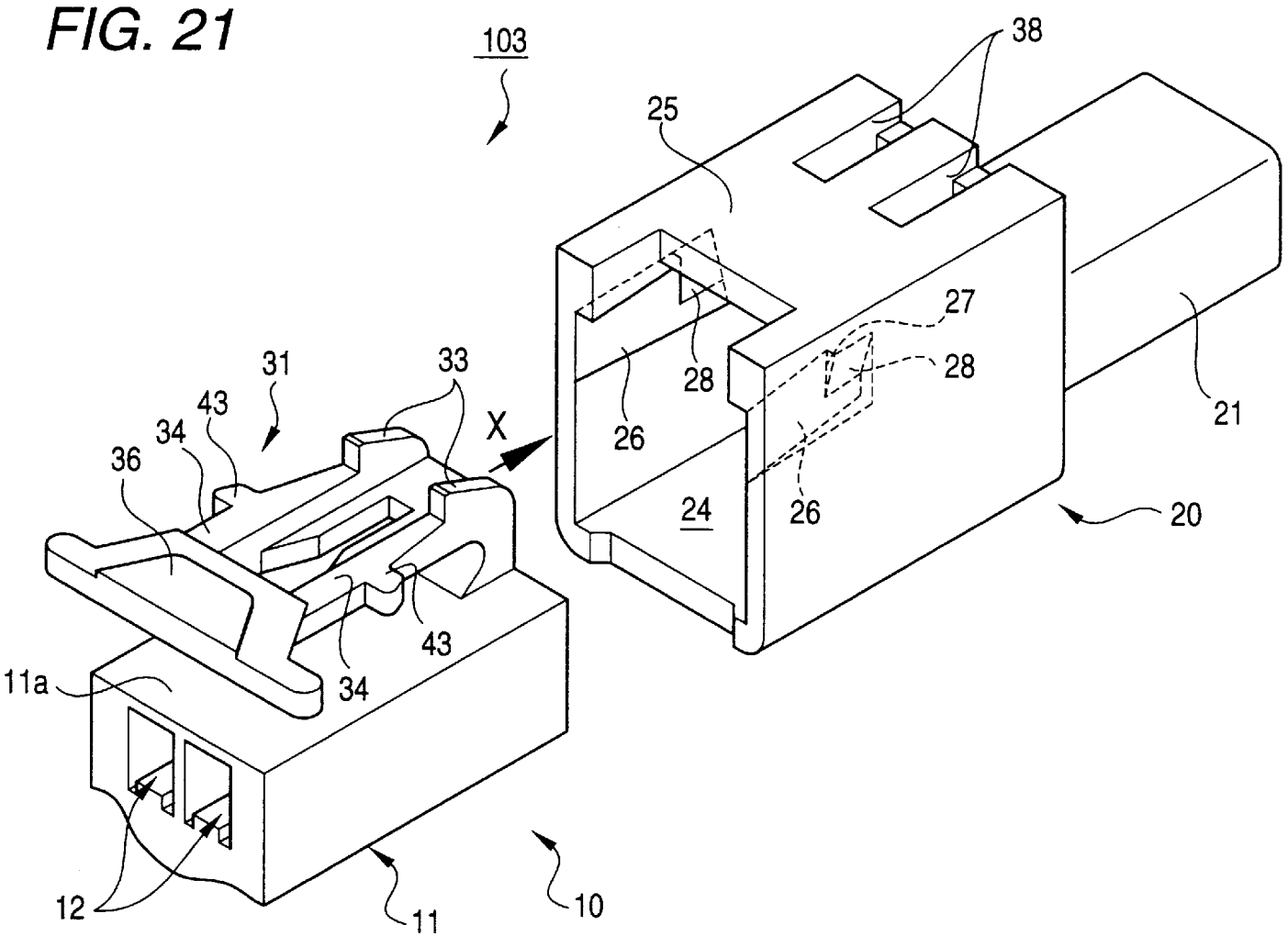
FIG. 21 is an exploded perspective view of a fourth embodiment of a connector lock mechanism according to the invention.
Figure 22:
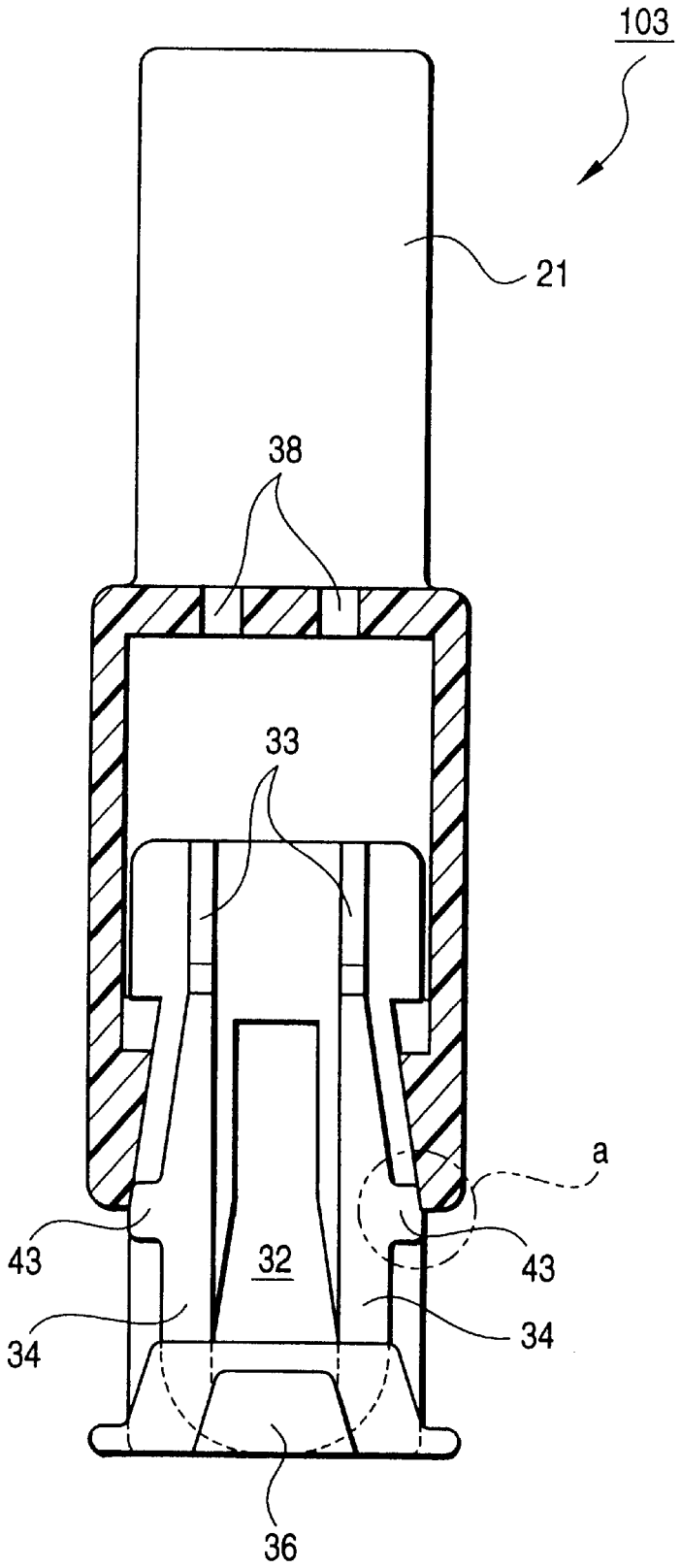
FIG. 22 is a plan view of the connector lock mechanism shown in FIG. 21, showing the engagement between the male and female connectors.
Figure 23:
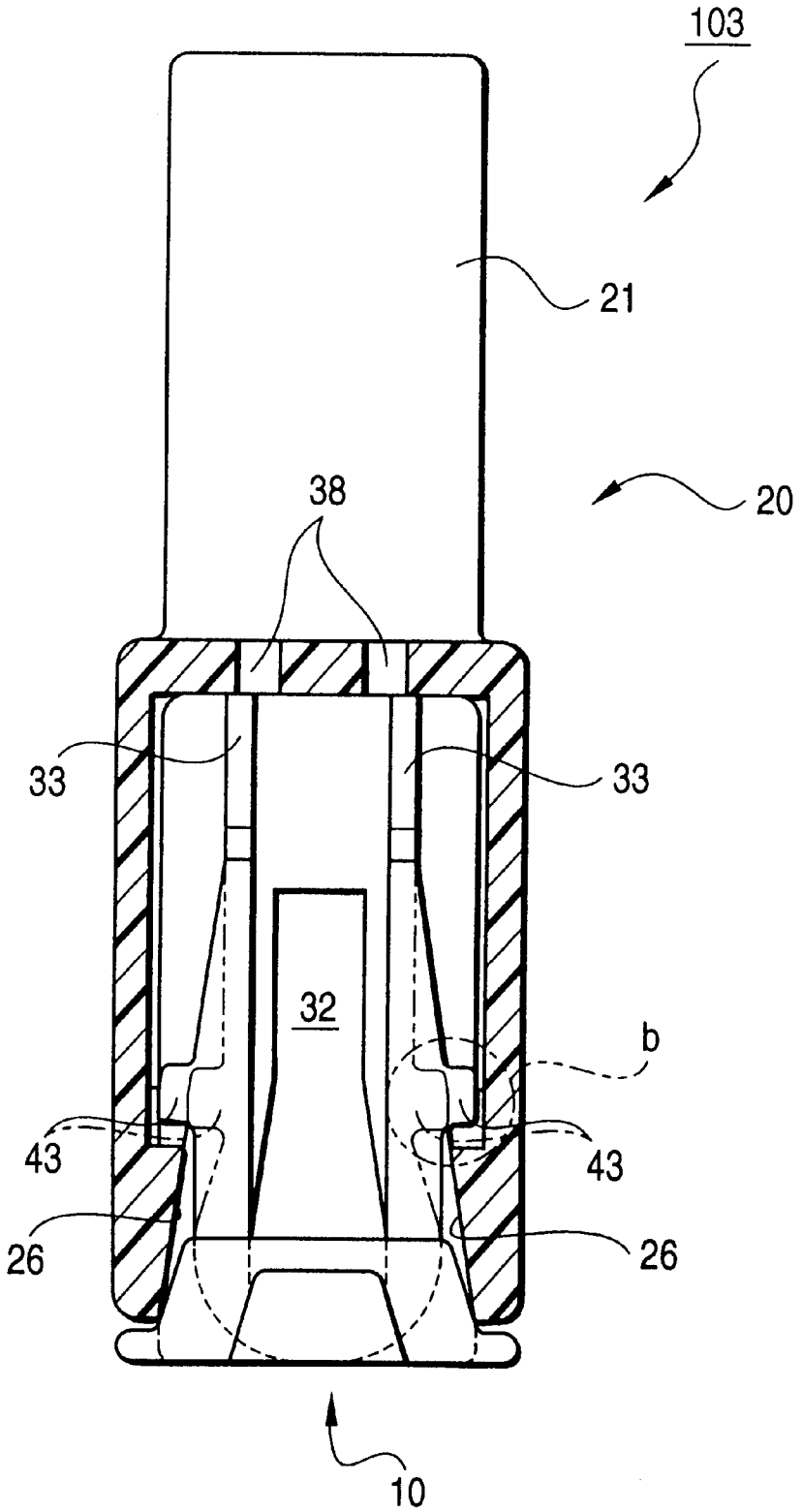
FIG. 23 is a plan view of the connector lock mechanism shown in FIG. 21, showing the complete engagement between male and female connectors.
Figure 24:
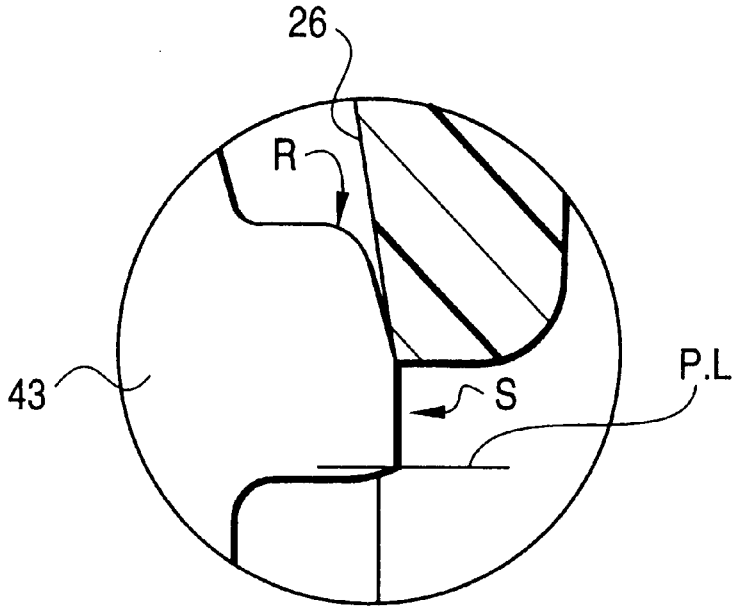
FIG. 24 is an enlarged plan view of the main portions of the connector lock mechanism shown in FIG. 21, showing the contact condition between the engaging projection and push-out guide surface shown in FIG. 22.
Figure 25:
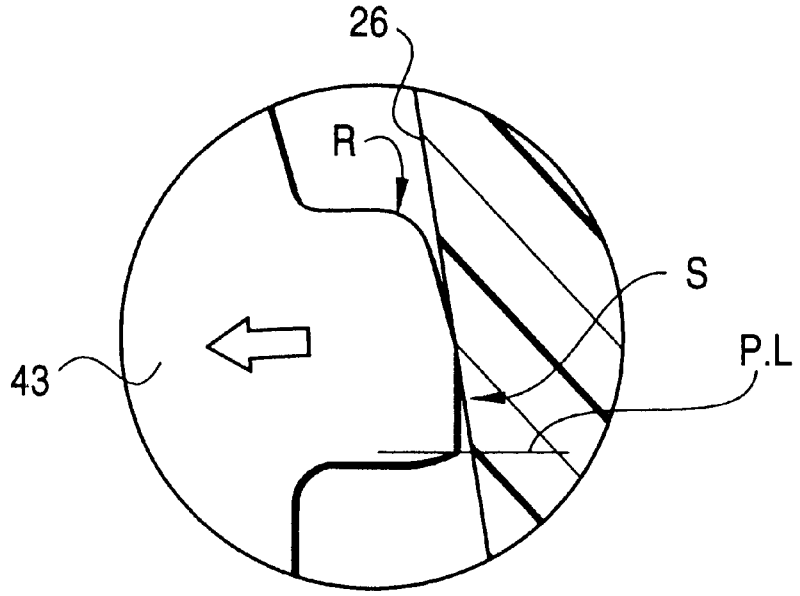
FIG. 25 is an enlarged plan view of the main portions of the connector lock mechanism shown in FIG. 21, showing the contact condition between the engaging projection and push-out guide surface in the intermediate stage of the engagement between the male and female connectors shown in FIG. 24.
Figure 26:
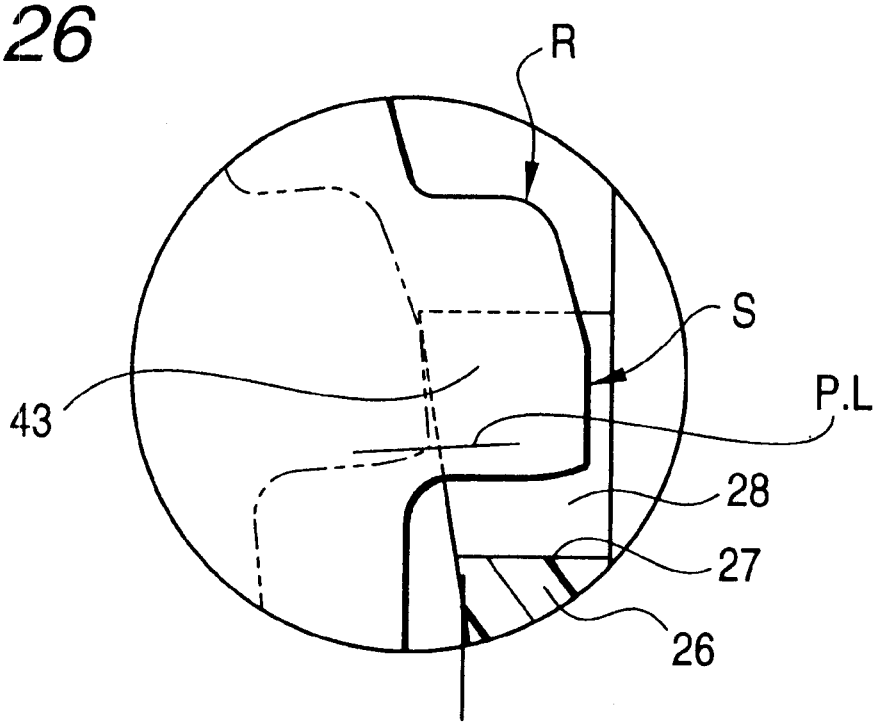
FIG. 26 is an enlarged plan view of the main portions of the connector lock mechanism shown in FIG. 21, showing the contact condition between the engaging projection and push-out guide surface in the complete engagement between the male and female connectors shown in FIG. 23.
Figure 27:
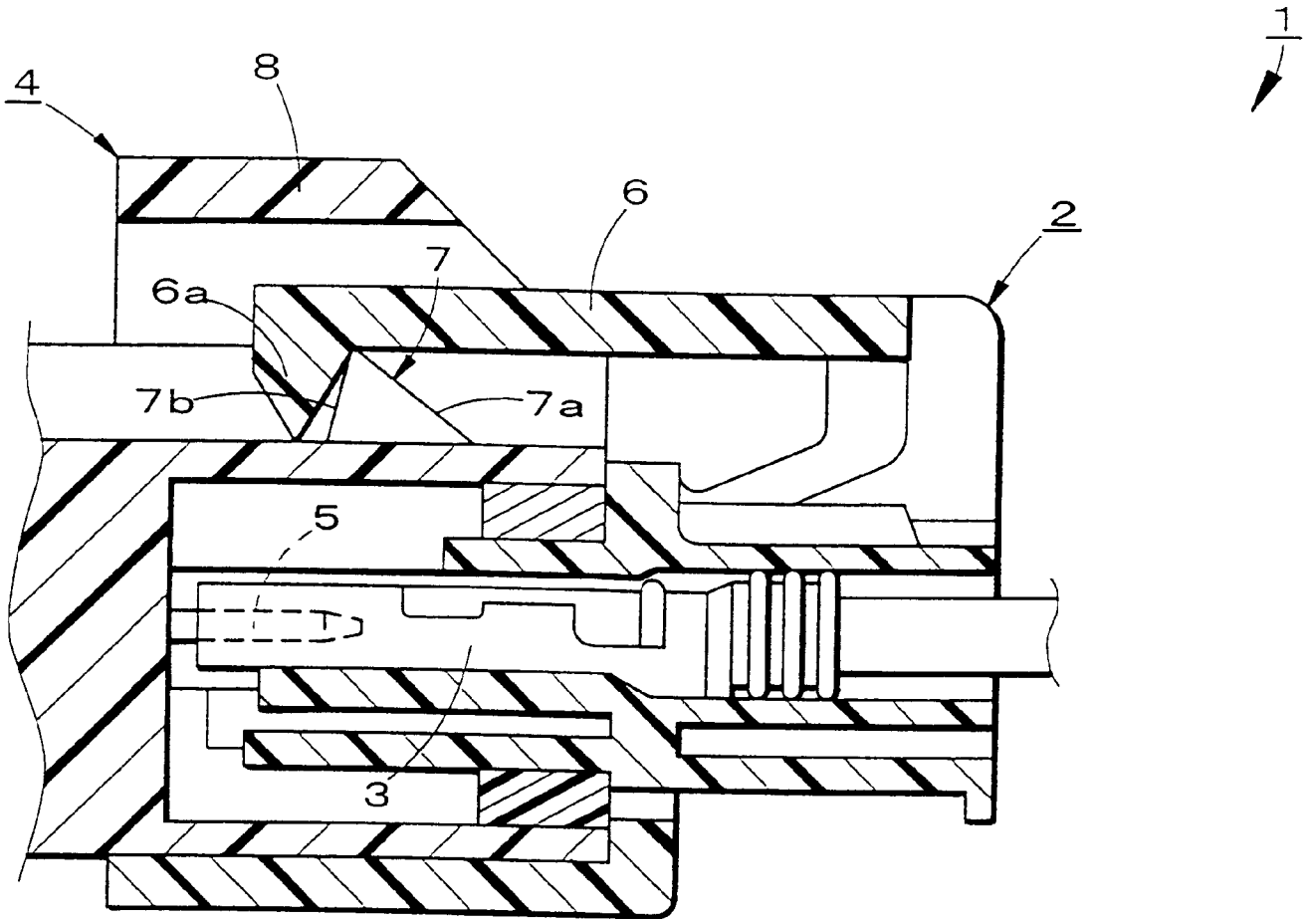
FIG. 27 is a longitudinal sectional view of a conventional connector lock mechanism, showing the engagement between the male and female connectors.

Next, description will be given below in detail of a fourth embodiment of a connector lock mechanism according to the invention with reference to FIGS. 21 to 26. In particular, FIG. 21 is a perspective view of the structure of a connector lock mechanism according to the fourth embodiment; FIGS. 22 and 23 are respectively plan views of the connector lock mechanism according to the present embodiment, showing an operation to be executed as male and female connectors are connected together; and, FIGS. 24 to 26 are respectively partially enlarged plan views of the present connector lock mechanism, showing the operation of engaging projections employed in the present connector lock mechanism. By the way, the present embodiment is different from the previously described respective embodiments mainly in that the shapes of the engaging projections provided in the flexible arm are changed. Therefore, in the present embodiment, the same parts thereof as those employed in the previous embodiments are given the same designations and thus the detailed description thereof is omitted here.

Referring in particular to the structure of the connector lock mechanism 103 according to the present embodiment, in the flexible arm 31, there is formed a space 32 which is substantially identical in shape with the space employed in the previously described second embodiment. On the two sides of a pair of flexible elastic pieces 34 which define the space 32, there are provided a pair of engaging projections 43.

The leading end portions of the pair of engaging projections 43, that is, the surfaces thereof that are to be contacted with the pair of push-out guide surfaces 26, as shown in FIGS. 24 to 26 in a partially enlarged manner, are different in shape from those employed in the previously described respective embodiments. That is, with a portion a shown in FIG. 22 is shown in a partially enlarged manner, as shown in FIG. 24, the front end faces of the engaging projections 43, which first contact the front end portions of the pair of push-out guide surfaces 26 when inserting the male connector 10 into the female connector 20, are respectively formed with an arc surface R shape. Also, the leading end faces of the engaging projections 43 to be contacted with the pair of push-out guide surfaces 26 as the male connector 10 is engaged with the female connector 20 are respectively formed with a straight surface S shape.

As shown in FIGS. 21 and 22, when pushing the male connector 10 into the female connector 20, the leading end of the male connector 10 is inserted into the engagement recess 24 of the female connector 20. In this operation, the arc surfaces R of the pair of engaging projections 43, as shown in FIG. 24, first contact the pair of push-out guide surfaces 26 respectively. Thereafter, the surfaces of the engaging projections 43 located adjacent to the straight surfaces S thereof respectively contact the pair of push-out guide surfaces 26, so that the male connector inserting operation can be carried out without incurring large resistance.

If the male connector 10 is inserted to the intermediate portion of the female connector 20, then the flexible elastic pieces 34 are respectively deformed in such a manner as to reduce the space 32. At this time, as shown in FIG. 25, the straight surfaces S of the pair of engaging projections 43 are contacted with the push-out guide surfaces 26 respectively.

As shown in FIG. 23, in a state where the male connector 10 is pushed into the engagement recess 24 of the female connector 20 completely, the pair of engaging projections 43 are engaged with the engaging portions (stepped surfaces) 27 (see FIG. 1), respectively. FIG. 26 shows the manner in which the engaging projections 43 and guide surfaces 28 are engaged with each other; and, in particular, FIG. 26 shows the portion b shown in FIG. 23 in a partially enlarged manner.

In the connector lock mechanism 103 according to the present embodiment, with use of the above-mentioned shapes of the pair of flexible elastic pieces 34 and engaging projections 43, not only the mutual engagement between the male and female connectors 10 and 20 can be easily removed similarly to the previously described respective embodiments, but also there can be provided the following features.

That is, while the male connector 10 is molded by metal molds, as shown in FIG. 24, the mold matching portions (mold matching lines) PL of the metal molds used to mold the male connector 10 are formed on the straight surfaces S rear end sides of the pair of engaging projections 43. With use of this structure, when pushing the male connector 10 into the female connector 20, as shown in FIGS. 24 to 26, there is no possibility that the mold matching portions PL can contact the push-out guide surfaces 26.

Generally, the mold matching portions PL are liable to incur projections such as burrs or the like in the molding operation, but, according to the present embodiment, even if such projections are present, the molding matching portions PL are prevented from coming into contact with the push-out guide surfaces 26, which makes it possible to surely prevent an increase in frictional resistance caused by such projections or the like. Due to this, not only when engaging the male connector 10 with the female connector 20, but also when removing the male connector 10 from the female connector 20 using the elastic operations of the pair of flexible elastic pieces 34, the sliding property between the pair of engaging projections 43 and push-out guide surfaces 26 is improved, so that the connector engaging operation as well as the connector removing operation can be carried out smoothly.

Next, description will be given below of a fifth embodiment of a connector lock mechanism according to the invention. This embodiment relates to metal molds which are used to mold the male and female connectors 10 and 20, while the present embodiment can be applied to all of the male and female connectors 10 and 20 that have been illustrated in the previously described first to fourth embodiments. That is, the present embodiment relates to metal molds which are used to mold the male and female connectors 10 and 20 and also which, when engaging the male connector 10 with the female connector 20 or when removing the male connector 10 from the female connector 20, can finish the metal mold surfaces for molding the mutually contacting surfaces of the male and female connectors 10 and 20 with mirror surfaces.

Such contact surfaces include the side surfaces and bottom surface of the male connector 10, the side surfaces and bottom surface that are respectively formed within the engagement recess 24 of the female connector 20, the gently inclined surfaces of the securing projections 16, 33, the surfaces of the engaging projections 19, 35, 43, the surfaces of the push-out guide surfaces 26, and the like.

According to the present embodiment, since the mutual contact surfaces of the male and female connectors 10 and 20 are molded by the mirror-surface finished metal molds, not only the operation to engage the male connector 10 with the female connector 20 but also the operation to remove the former from the latter can be executed smoothly.

As has been described heretofore, a connector lock mechanism according to the invention comprises a pair of flexible elastic pieces respectively provided on the two side portions of a flexible arm, a pair of engaging projections respectively provided on the respective outer surfaces of the pair of flexible elastic pieces, a pair of taper-surface-shaped push-out guide surfaces respectively formed in the inner surfaces of an engagement recess formed in the other connector in such a manner that their associated engaging projections can be slid on the push-out guide surfaces as one connector is engaged with or removed from the other connector, a pair of engaging portions respectively formed in the engagement recess of the other connector in such a manner that the engaging projections can be respectively secured to the engaging portions when one connector is completely engaged with the other connector, and a pair of guide surfaces respectively formed in the engagement recess of the other connector in such a manner that, as the flexible elastic pieces are flexed and deformed together with the flexible arm, they can guide the engaging projections from the engaging portions onto the push-out guide surfaces to thereby remove the mutual engagement between the engaging projections and the engaging portions.

Also, in the above-mentioned connector lock mechanism, the flexible arm includes a space which is capable of shifting the pair of flexible elastic pieces in their respective inward directions, and one connector always receives from the engagement recess of the other connector a removing force to act on one connector in its removing direction except when one connector is completely engaged with the other connector.

According to above-mentioned connector lock mechanism, preferably, the flexible arm may comprise a securing projection which includes a forwardly descending, gently inclined surface capable of sliding on the lower surface of a securing portion formed on the other connector side as the two connectors are engaged with each other, and also which, when the two connectors are completely engaged with each other, can be engaged with the securing portion of the other connector.

Therefore, as one connector is engaged with the other connector, the pair of flexible elastic pieces are respectively pressed against their associated push-out guide surfaces, while part of a repulsive force generated correspondingly to the pressing force of the flexible elastic pieces acts on one connector. Due to this, until the flexible arm and securing portion are completely engaged with each other and thus the two connectors are completely engaged with each other, one connector receives from the other connector a strong removing force which pushes one connector in the removing direction, which makes it possible to be able to prevent incomplete engagement between the two connectors.

Also, in a state where the two connectors are engaged together completely, since the engaging projections provided in the pair of flexible elastic pieces and the engaging portions of the other connector are engaged with each other, the two connectors can be locked in the engagement condition more strongly.

In order to remove the engagement between the flexible arm and securing portion to thereby separate or remove the two connectors from each other, if the flexible arm is flexed and shifted, then the flexible elastic pieces are flexed and shifted integrally with the flexible arm. At this time, the flexible elastic pieces are guided onto the push-out guide surfaces by the guide surfaces, so that the engagement thereof with their associated engaging portions can be removed at the same time when they are flexed and shifted.

Also, even while the flexible arm is flexed and shifted, the flexible elastic pieces are pressed against the push-out guide surfaces, so that one connector always receives a removing force from the other connector.

Therefore, not only the incomplete or half engagement between the two connectors can be surely prevented but also an operation to remove the two connectors from each other can be executed easily, thereby being able to enhance the efficiency of the connector removing operation.

Also, according to another aspect of the invention, there is provided a connector lock mechanism which comprises: a pair of flexible elastic pieces respectively provided on the two side portions of a flexible arm and including a space which is formed between them and is capable of shifting the two flexible elastic pieces in their respective inward directions; a pair of engaging projections respectively provided on the outer surfaces of the pair of flexible elastic pieces; and, a pair of push-out guide surfaces which are respectively formed in the inner surfaces of an engagement recess formed in the other connector as tapered surfaces and also on which the pair of engaging projections are allowed to slide as the other connector is engaged with or removed from one connector, in which the pair of flexible elastic pieces are formed obliquely with respect to the engaging direction of one connector in order to be able to increase a removing force which is always applied to one connector from the engagement recess of the other connector as one connector is engaged with or removed from the other connector except when one connector is engaged with the other connector completely.

According to the above-mentioned connector lock mechanism, preferably, the engagement recess of the other connector may include engaging portions to which the engaging projections can be secured when the other connector is engaged with one connector completely, and guide surfaces which, when the flexible elastic pieces are flexed and shifted together with flexible arm, can guide the engaging projections from the engaging portions onto the push-out guide surfaces to thereby remove the engagement between the engaging projections and engaging portions.

Also, according to the above-mentioned connector lock mechanism, preferably, the front end faces of the engaging projections which can slide on the push-out guide surfaces as one connector is pushed into the engagement recess of the other connector may be respectively formed as arc surfaces, and the leading end faces of the engaging projections that are to be contacted directly with the push-out guide surfaces may be respectively formed as straight surfaces.

Further, according to the above-mentioned connector lock mechanism, preferably, the mold matching positions of metal molds used to mold the connectors may be set in the rear end portions of the straight surfaces of the engaging projections, thereby preventing projections from being formed on the straight surfaces of the engaging projections that are to be contacted with the push-out guide surfaces; that is, the surfaces of the connectors that contacted each other as the two connectors are engaged with and removed from each other can be molded by the metal molds that have been mirror-surface finished.

Therefore, if the flexible elastic pieces are formed obliquely with respect to the engaging direction of one connector, then the amount of deformation of the flexible elastic pieces increases to thereby increase the removing force which pushes out one connector from the other connector. As a result of this, not only the incomplete or half engagement between a set of connectors can be detected positively, but also the operation to remove the two connectors from each other can be executed easily.

Also, the surfaces to be contacted with each other when a set of connectors are engaged with or removed from each other are molded using the metal molds that have been mirror-surface finished, the leading end faces of the engaging projections to be contacted with the push-out guide surfaces are formed as the straight surfaces, and the mold matching positions of the metal molds used to mold the connectors are set in the rear end portions of the above-mentioned straight surfaces. Therefore, friction resistance between the two connectors can be reduced, the removing force can be increased, and the operations to engage the two connectors with each other and remove them from each other can be carried out smoothly and positively. That is, according to the invention, there can be provided a structure which is capable of increasing the removing force, the incomplete engagement between the two connectors can be prevented, and the efficiency of the operation to remove one connector from the other can be enhanced.

What is claimed is:

1. A connector lock mechanism structured such that a flexible arm is provided in one of a set of connectors to be engaged with each other, said one connector is engaged into an engagement recess formed in the other connector, and, by flexing said flexible arm, said one connector is pulled out from said engagement recess to thereby remove said set of connectors from each other, said connector lock mechanism comprising:

a pair of flexible pieces respectively provided on two side portions of said flexible arm;

a pair of engaging projections respectively provided on respective outer surfaces of said pair of flexible pieces;

a pair of tapered push-out guide surfaces respectively formed in inner surfaces of said other connector partially defining said engagement recess, said engaging projections being slideable on said push-out guide surfaces as said one connector is engaged with or removed from said engagement recess;

a pair of engaging portions respectively formed in said engagement recess of said other connector, said engaging projections being respectively engageable with said engaging portions when said other connector is completely engaged with said one connector; and, a pair of guide surfaces respectively formed in said engagement recess in such a manner that, when said flexible pieces are flexed and shifted together with said flexible arm, said flexible pieces guide said engaging projections from said engaging portions onto said push-out guide surfaces to thereby remove the mutual engagement between said engaging projections and said engaging portions.

2. A connector lock mechanism as set forth in claim 1, wherein said flexible arm includes a space capable of shifting said pair of flexible pieces respectively in the inward directions thereof.

3. A connector lock mechanism as set forth in claim 1, wherein said one connector receives from said engagement recess of said other connector a removing force acting in a removing direction thereof as said one connector is engaged with and removed from said other connector except when said one connector is completely engaged with said other connector.

4. A connector lock mechanism as set forth in claim 1, wherein said flexible arm comprises a securing projection which includes a forwardly descending, gently inclined surface which is slideable on the lower surface of a securing portion formed in said other connector as said two connectors are engaged with each other, and also which, when said two connectors are completely engaged with each other, can be engaged with said securing portion of said other connector.

5. A connector lock mechanism structured such that a flexible arm is provided in one of a set of connectors to be engaged with each other in an engagement direction, said one connector is received in an engagement recess formed in the other connector, and, by flexing said flexible arm, said one connector is urged out of said engagement recess to thereby remove said set of connectors from each other, said connector lock mechanism comprising:

a pair of flexible pieces respectively provided on the two side portions of said flexible arm and including a space formed therebetween to allow said flexible pieces to be deformed in an inward directions thereof;

a pair of engaging projections respectively provided on outer surfaces of said pair of flexible pieces; and a pair of push-out guide surfaces respectively formed as tapered surfaces in the inner surfaces of said engagement recess of said other connector in such a manner that said pair of engaging projections slide on said push-out guide surfaces as said one connector is engaged with or removed from said engagement recess of said other connector, wherein said pair of flexible pieces are formed obliquely with respect to the engaging direction of said one connector in order to be able to increase a removing force which is applied to said one connector from said engagement recess of said other connector as said one connector is engaged with and removed from said other connector except when said one connector is completely engaged with said other connector.

6. A connector lock mechanism as set forth in claim 5, wherein said engagement recess includes engaging portions to which said engaging projections can be secured as said other connector is engaged with said one connector completely, and guide surfaces which, when said flexible pieces are flexed and shifted together with said flexible arm, guide said engaging projections from said engaging portions onto said push-out guide surfaces to thereby remove the engagement between said engaging projections and said engaging portions.

7. A connector lock mechanism as set forth in claim 1, wherein the front end faces of said engaging projections which slide on said push-out guide surfaces when said one connector is pushed into said engagement recess of said other connector are respectively formed as arc surfaces, and the leading end faces of said engaging projections that contact said push-out guide surfaces are respectively formed as straight surfaces.

8. A connector lock mechanism as set forth in claim 7, wherein the mold matching positions of metal molds used to mold said connectors are set in the rear end portions of said straight surfaces of said engaging projections, thereby preventing projections from being formed on said straight surfaces of said engaging projections that contact said push-out guide surfaces.

9. A connector lock mechanism as set forth in claim 1, wherein the surfaces of said two connectors, which contacted each other when said two connectors are engaged with or removed from each other, are molded by metal molds which have a mirror-surface finish.

10. A connector lock mechanism as set forth in claim 9, wherein said surfaces of said two connectors, which have been mirror-surface finished by said metal molds, include at least one of said engaging projections, said push-out guide surfaces, said gently inclined surface of said securing projection of said flexible arm, the bottom surface of said engagement recess of said other connector, and the lower surface of the housing of said one connector.

11. A connector lock mechanism as set forth in claim 5, wherein the front end faces of said engaging projections which slide on said push-out guide surfaces when said one connector is pushed into said engagement recess of said other connector are respectively formed as arc surfaces, and the leading end faces of said engaging projections that contact said push-out guide surfaces are respectively formed as straight surfaces.

12. A connector lock mechanism as set forth in claim 5, wherein the surfaces of said two connectors, which contacted each other when said two connectors are engaged with or removed from each other, are molded by metal molds which have a mirror-surface finish.

13. A connector comprising:

a first connector and a second connector, said first connector being receivable in an engaging recess of said second connector;

a flexible arm provided on said first connector, said flexible arm including a pair of flexible pieces defining a space therebetween;

a pair of engaging projections respectively provided on respective outer surfaces of said pair of flexible pieces;

a pair of tapered push-out guide surfaces respectively formed on inner surfaces of said second connector which partially define said engagement recess, said engaging projections being slideable on said push-out guide surfaces as said first connector is received in and removed from said engagement recess;

a pair of engaging portions respectively formed in said engagement recess of said second connector, said engaging projections being respectively engageable with said engaging portions when said second connector is completely engaged with said first connector; and, a pair of guide surfaces respectively formed in said engagement recess in such a manner that, when said flexible pieces are flexed and shifted together with said flexible arm, said flexible pieces guide said engaging projections from said engaging portions onto said push-out guide surfaces to thereby remove the mutual engagement between said engaging projections and said engaging portions.

14. A connector as set forth in claim 13, wherein said flexible arm includes a space capable of shifting said pair of flexible pieces respectively in the inward directions thereof.

15. A connector as set forth in claim 13, wherein said one connector receives from said engagement recess of said other connector a removing force acting in the removing direction thereof as said one connector is engaged with and removed from said other connector except when said one connector is completely engaged with said other connector.

16. A connector as set forth in claim 13, wherein said flexible arm comprises a securing projection which includes a forwardly descending, gently inclined surface capable of sliding on the lower surface of a securing portion formed in said other connector as said two connectors are engaged with each other, and also which, when said two connectors are completely engaged with each other, can be engaged with said securing portion of said other connector.

* * * * *